US006404837B1

(12) United States Patent
Thompson et al.

(10) Patent No.: US 6,404,837 B1
(45) **Date of Patent: *Jun. 11, 2002**

(54) USAGE COMPETENT HAND SOAP DISPENSER WITH DATA COLLECTION AND DISPLAY CAPABILITIES

(75) Inventors: Luke P. Thompson, Woodbury; James L. Copeland, Apple Valley; Ronald B. Howes, Jr., Minneapolis, all of MN (US)

(73) Assignee: Ecolab, Inc., St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/096,079

(22) Filed: Jun. 11, 1998

(51) Int. Cl.[7] ..... G06M 3/08
(52) U.S. Cl. ..... 377/13; 377/15; 377/16
(58) Field of Search ..... 377/13, 15, 16

(56) References Cited

U.S. PATENT DOCUMENTS

| | | | | |
|---|---|---|---|---|
| 3,119,557 A | | 1/1964 | Chapman | 235/91 |
| 3,606,084 A | | 9/1971 | Morrone | 222/38 |
| 4,188,984 A | | 2/1980 | Lyall | 141/12 |
| 4,265,370 A | | 5/1981 | Reilly | 222/25 |
| 4,349,133 A | | 9/1982 | Christine | 222/183 |
| 4,394,938 A | | 7/1983 | Frassanito | 222/207 |
| 4,606,085 A | | 8/1986 | Davies | 4/623 |
| 4,621,749 A | | 11/1986 | Kanfer | 222/153 |
| 4,715,517 A | | 12/1987 | Potter et al. | 222/181 |
| 4,765,515 A | | 8/1988 | Lippman | 222/162 |
| 4,774,916 A | | 10/1988 | Smith | 123/180 |
| 4,896,144 A | | 1/1990 | Bogstad | 340/691 |
| 4,921,131 A | | 5/1990 | Binderbauer et al. | 222/52 |
| 4,938,384 A | | 7/1990 | Pilolla et al. | 222/52 |
| 4,989,755 A | | 2/1991 | Shiau | 222/63 |
| 5,199,118 A | | 4/1993 | Cole et al. | 4/619 |
| 5,248,066 A | | 9/1993 | Olson et al. | 222/105 |
| 5,370,267 A | | 12/1994 | Schroeder | 222/1 |
| 5,397,028 A | | 3/1995 | Jesadanont | 222/1 |
| 5,625,659 A | | 4/1997 | Sears | 377/21 |
| 5,625,908 A | | 5/1997 | Shaw | 4/623 |
| 5,860,437 A | * | 1/1999 | Fernie | 134/95.2 |
| 5,945,910 A | | 8/1999 | Gorra | 340/573.1 |

FOREIGN PATENT DOCUMENTS

| | | |
|---|---|---|
| GB | 2 298 851 A | 9/1996 |

* cited by examiner

*Primary Examiner*—Tuan T. Lam
(74) *Attorney, Agent, or Firm*—Merchant & Gould P.C.

(57) ABSTRACT

A device which measures individual employee usage of a liquid product or hand soap dispenser as part of an overall hygiene compliance program. The dispenser consists of a self-contained keypad/display module which is attached to a standard hand soap dispenser. An employee enters a unique personal ID code and then activates the dispenser. The dispenser counts all inputs to the dispenser in order to generate meaningful data for management. Alternatively, the dispenser may only track and report total usage and not account for individual employee usage.

18 Claims, 18 Drawing Sheets

400
Start
402

Initialization
404
Display 'Init.' on the display.
406
408
Read inputs.
410
YES
Any active inputs?
NO
412
10 sec. timeout?
NO
YES
Clear the display.
414
416
Put processor into 'Sleep' mode.
424
Sleep
418
NO
Wait for key activation.
(Port B interrupt)
?
YES
Processor will wake up
from 'Sleep' mode.
420
Read inputs.
422
401

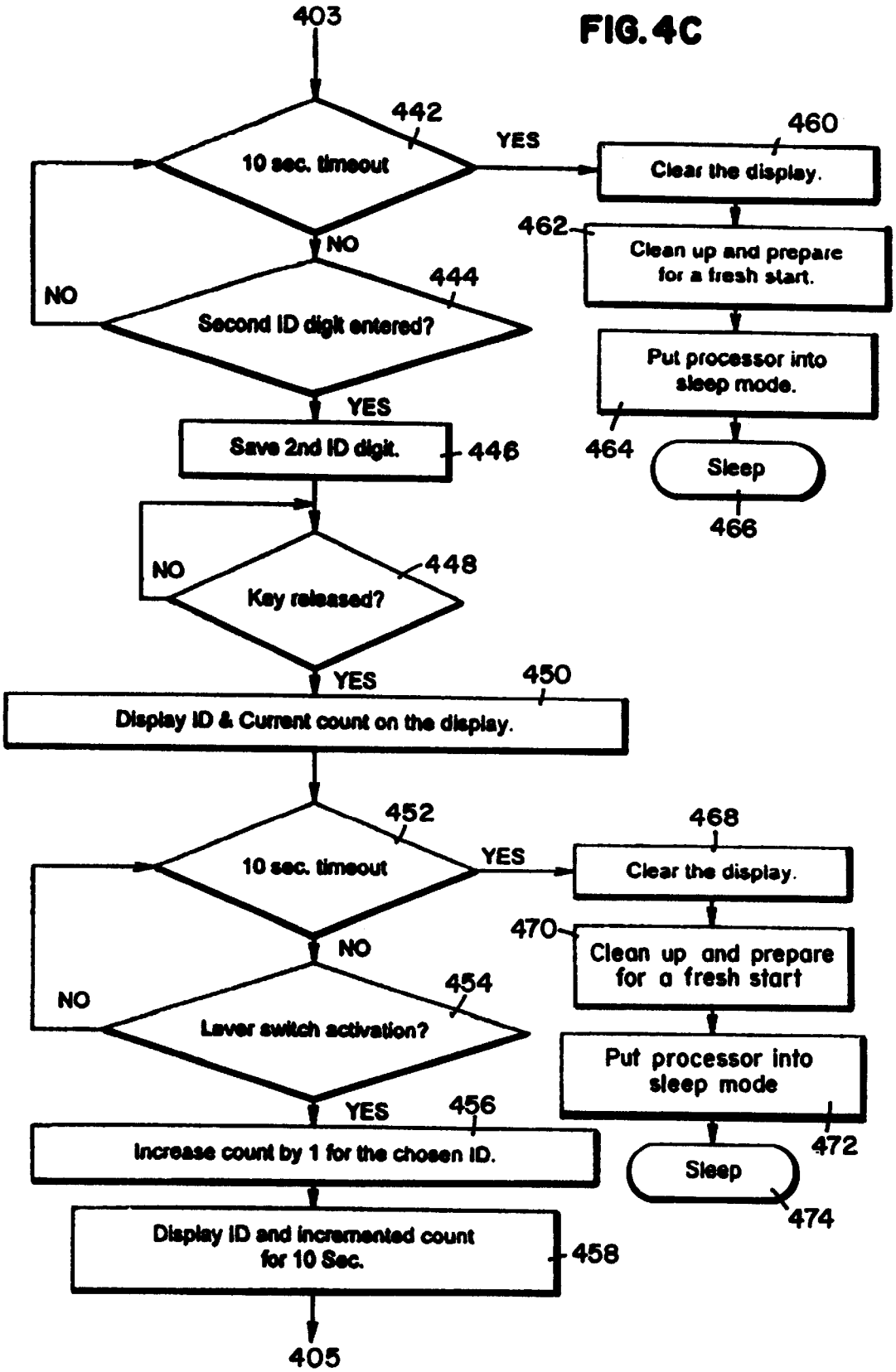
FIG. 4C
403
442
10 sec. timeout
YES
NO
460
Clear the display.
462
Clean up and prepare for a fresh start.
Put processor into sleep mode.
464
Sleep
466
444
Second ID digit entered?
NO
YES
Save 2nd ID digit.
446
448
Key released?
NO
YES
450
Display ID & Current count on the display.
452
10 sec. timeout
YES
NO
468
Clear the display.
470
Clean up and prepare for a fresh start
Put processor into sleep mode
472
Sleep
474
454
Lever switch activation?
NO
YES
456
Increase count by 1 for the chosen ID.
Display ID and incremented count for 10 Sec.
458
405

USAGE COMPETENT HAND SOAP DISPENSER WITH DATA COLLECTION AND DISPLAY CAPABILITIES

FIELD OF THE INVENTION

The invention is directed generally to usage data competent dispensers for liquid materials used in personal sanitary practices including hand soap or sanitizer compositions. More specifically, the invention is directed to a dispenser for a liquid product that includes means for usage monitoring and usage data collection. The invention is directed specifically to assisting in monitoring or enforcing compliance of personnel with hygiene control regulations, particularly in the health care and food preparation industries using a system that collects usage data and presents the data in a useful and accessible form.

BACKGROUND OF THE INVENTION

Ensuring sufficient levels of hygiene compliance, including hand washing, in the health care industry in food preparation, including fast food restaurants, and in other product and service functions is a continuing management goal. Many attempts have been made by those of skill in the art to achieve this end. Adequate personal hygiene, including hand washing, is an integral part of ensuring uncontaminated workers and product and in promoting customer health and safety.

The prior art describes commercially available hand soap dispensers. Such dispensers are generally wall mounted and include a cover which is usually hinged to the mounting base. The dispenser includes a disposable liquid product container such as a cartridge or flexible bag. The soap is frequently available in valved disposable container that dispenses the product upon user input. U.S. Pat. No. 5,248,066, issued to Olson et al, describes a typical hand soap dispenser of the type which would be useful with the present invention. Other hand soap dispensers are disclosed in U.S. Pat. No. 4,765,515 issued to Lippman; U.S. Pat. No. 4,921,131 issued to Binderbauer et al; U.S. Pat. No. 4,938,384 issued to Pilolla et al; U.S. Pat. No. 4,621,749 issued to Kanfer and U.S. Pat. No. 4,715,517 issued to Potter et al. These references describe dispensers in which push bars are activated by the user in order to energize a valve or other dispensing means to obtain a liquid portion or a predetermined amount of soap. The specific manner in which the soap is stored and placed in the dispenser is well documented in the art. For example, McDermott, et al, U.S. Pat. No. 4,667,854 discloses a liquid hand soap dispenser which utilizes a valved collapsible bag which is contained within an outer casing such as a cardboard box to provide support. Roggenburg, Jr. et al, U.S. Pat. No. 4,570,827, discusses a liquid dispenser which includes a flexible bag which is formed with two chambers, a supply chamber and a discharge chamber, and the bag is suspended in the housing from projecting pins. These dispensers are frequently used in environments such as hospitals and restaurants which require stringent sanitation. The appropriate regulatory bodies have determined that on average these sanitation requirements can be met if a predetermined number of hand washings per employee occur during a particular amount of time Consequently, a need arose for dispensers which could keep a running tally of total usage.

There are examples of dispensers which are able to count total usage. U.S. Pat. No. 4,265,370, issued to Reilly, discloses a portable liquid metering device for temporary attachment to a liquid container. This device counts the number of times in which the container is tipped in order to discharge material. Chapman, U.S. Pat. No. 3,119,557, discloses a counter suitable for detecting applications of spray paint. Morrone, U.S. Pat. No. 3,606,084 discloses a counter for detecting the number of drinks dispensed. Sears, U.S. Pat. No. 5,625,659, discloses a device which can count total usage of a given hand soap dispenser. This device attempts to resolve usage of individual employees by selectively disabling the counter during periods ascribed to multiple inputs or usages by a single individual.

Usage counters can fail to account for situations in which data is missed during periods of no data accumulation in disabled periods. Further, the mere presence of hand soap dispensers which are capable of dispensing a predetermined amount of soap is inadequate in assuring compliance with hand washing regulations. Even the use of dispensers which are capable of tracking total use can fail to ensure compliance since they are incapable of resolving all usage by individual employees. Consequently, there are examples in the art of various attempts to force compliance with the hand washing regulations required for compliance with hygiene guidelines.

One possible approach is to make hand washing easier. Cole et al, U.S. Pat. No. 5,199,118, discloses a hand sanitizing station which automatically dispenses soap, turns on the water and then activates a hot air dryer, all in response to proximity sensors. Shaw, U.S. Pat. No. 5,625,908, discusses a similar station wherein a length of paper towel is dispensed in place of the hot air dryer. While these devices may make hand washing easier, they fail to monitor or enforce compliance. Davies, U.S. Pat. No. 4,606,085, discloses a hand washing device suitable for use as a surgical scrub sink in which a timing circuit sounds an audible note to inform the user that a sufficient amount of time has been spent on hand washing. Bogstad, U.S. Pat. No. 4,896,144, discloses a particular embodiment in which a warning system is activated by the flushing of a toilet. The warning system is then deactivated by the actuation of hand washing facilities. Jesadanont, U.S. Pat. No. 5,397,028 discloses a device for discharging disinfectants in which a disinfectant is automatically released for a predetermined amount of time. NetTech International, of New Jersey markets a device called "Hygiene Guard" which is designed to improve employee hand washing compliance. However, this system requires each employee to wear a credit card size "smart" badge which is susceptible to damage, misreading by the dispenser, "borrowing", loss or theft. This system can also require extensive (and expensive) installation work in the customer's facility.

As demonstrated, there has been many varied attempts in the art to find a way to ensure monitoring or compliance with hand washing guidelines. We, however believe a substantial need remains for a cost-effective, simple-to-use device that will monitor and encourage personnel hygiene compliance and provide useful management data.

BRIEF SUMMARY OF THE INVENTION

Broadly speaking, the invention is found in a usage competent data collecting hand soap dispenser which can be used as part of an overall hygiene compliance program. In one embodiment, the dispenser can monitor usage by each individual employee while an alternative embodiment simplifies matters by only monitoring total usage without accounting for individual usage data.

In the first embodiment, a self-contained battery operated keypad/display module is used that is attached to a standard hand soap dispenser. An employee can enter a unique personal ID code and then can activate the dispenser within a predetermined time period in order for the usage to be properly recorded. The dispenser then counts the usage by the employee and discriminates that use from the use of previous and subsequent employee users. The displayed data can include the employee identification, the current employee usage count per day, per week etc., employee inputs per use, the total usage count, frequency of use (per individual or per period), dispenser operation data, etc. Optionally, a push button can be provided which triggers the data display. A supervisor can be enabled to retrieve all data including employee counts via a special code input. Such data can be taken in the form of an electronic record or file, a print-out or as a visual display.

The first embodiment of the invention is designed for use with existing hand soap dispenser technology and can be incorporated into new units during OEM manufacture or can be installed in existing units during maintenance. The unit cost is low enough to permit its installation on or its use in all dispensers in a facility. The design minimizes the interaction necessary to ensure compliance and as such reduce potential abuse or avoidance. This device does not require employees to wear tags or other identification devices. There are no parts which can be lost or stolen, and there are no special installation requirements.

The first embodiment of the invention involves a hand soap dispenser having an integral apparatus for electronically measuring the usage of a dispenser which is actuated by pressure on an activating member which, in turn, triggers the discharge of material from the dispenser upon movement of the activating member from a starting position to a dispensing position. The apparatus includes a counting apparatus carried by the dispenser; a numerical display, numerical storage and data manipulation capability and a data entry keypad electrically connected to said counting apparatus; a moveable switch actuator operative with a switch receptacle communicative with said counting apparatus.

An alternative embodiment involves a simplified version of the first embodiment. No distinction is made between individual users, and no data is collected, stored or calculated in regards to individual users. Usage is monitored only in terms of total requests for product, specifically liquid product (soap) use or consumption (per input, per use or per period). Soap is dispensed in response to a pressure input.

This embodiment of the invention is also designed for use with existing hand soap dispenser technology and can be incorporated into new units during OEM manufacture or can be installed in existing units during maintenance. The unit cost is low enough to permit its installation on or its use in all dispensers in a facility. The design minimizes the interaction necessary to ensure compliance and as such reduce potential abuse or avoidance. This device does not require employees to wear tags or other identification devices. There are no parts which can be lost or stolen, and there are no special installation requirements.

The alternative embodiment of the invention also involves a hand soap dispenser having an integral apparatus for electronically measuring the usage of a dispenser which is actuated by pressure on an activating member which, in turn, triggers the discharge of material from the dispenser upon movement of the activating member from a starting position to a dispensing position. The apparatus includes a counting apparatus carried by the dispenser, numerical storage and data manipulation means and a moveable switch actuator operative with a switch receptacle communicative with said counting apparatus. Said counting apparatus counting and accumulating one switch closure upon the activating member moving into a dispensing position so as to move said switch activator into a closed position with said switch receptacle and wherein a single use is determined to have occurred if a predetermined amount of time has elapsed since the previous activation.

The dispenser collects input and then the counter counts all switch closures but is able to discriminate between subsequent users and can calculate total usage (the number of people using the device), total soap consumption, soap consumption per person or use, frequency of switch closure in a single use by one individual, or other such data. The electronic counters can be calibrated and programmed to generate any data set useful for site managers. In a preferred mode the data is collected from an input comprising each application of pressure on a lever or bar that compresses a portion of the dispensing means producing a volume of the liquid. In typical uses the lever or bar is compressed two three or more times.

DETAILED DESCRIPTION OF THE INVENTION

Housing

Figure 1:
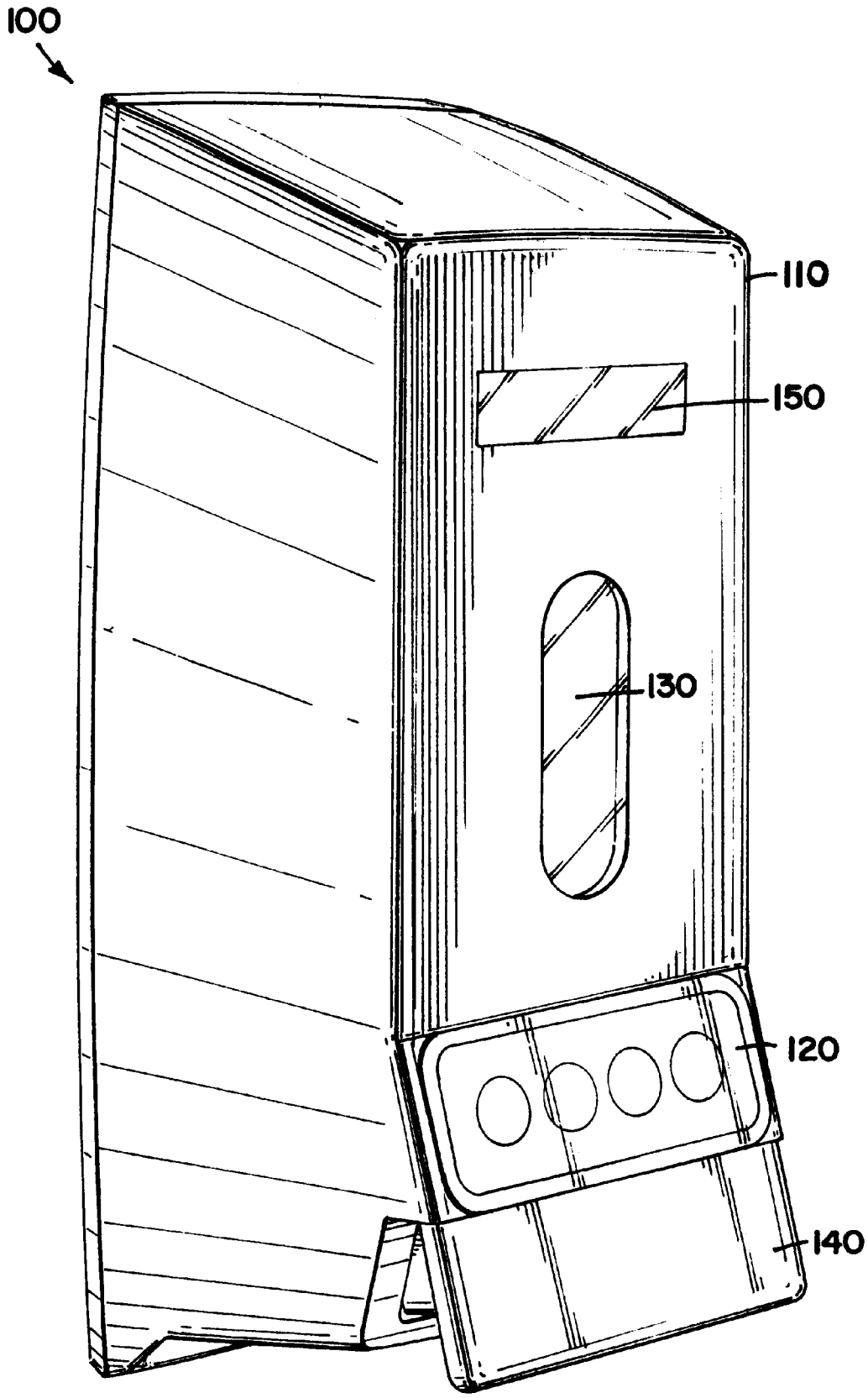
FIG. 1 is a perspective view of a dispenser representing the first embodiment.

The housing can be a removable housing placed directly over and enclosing, partially or completely, the internal working components of the dispenser. Alternatively, the housing can simply be a removable or replaceable shelf that can be placed over an intact dispenser using removable housing attachments.

The housing, and the important structural components of the dispenser can be molded of a variety of useful materials. Thermoplastic and thermosetting or composite materials can be used to make the housing. Alternatively, the housing can be made from metallic elements, however, polymeric thermoplastic or thermosetting (composite) materials are preferred. Preferably, the housing, dispenser components, etc. can be molded in one or more unitary pieces through the use of conventional plastic injection molding, thermoforming, blow molding, etc. techniques. A variety of plastic polymeric materials can be used in fabricating the holder including polyethylene, polypropylene, polystyrene, ABS plastics, urethane resins, epoxy resins, nylon resins and others. Preferred plastic materials include styrenic materials such as polystyrene or ABS, polyethylene, and polypropylene.

Dispenser

The dispenser contains both a source of a liquid chemical and the means to dispense it. As discussed below, the chemical can be provided in the form of a cartridge or flexible bag containing the chemical. Typically, the cartridge or flexible bag has a dispensing port from which the liquid chemical can be delivered to the user. Such a port can work cooperatively with dispensing means actuated by the user. The dispensing means can be a simple mechanical valve or pump, an electrical generated pump, or any other known device that can produce a useful volume of the liquid chemical. For liquid hand soap or sanitizing hand soap, the amount of soap can range from about 0.2 to about 5 milliliters, preferably about 0.5 to 3 milliliters in volume. A preferred means of delivering the liquid from the container dispenser comprises a flexible compressible tube, attached to a flexible container, that can act as a pump portion. When used, the user compresses a bar or other feature on the front of the housing. Such compression forces a compressing surface against the flexible tube. The flexible tube contains internal valve means that prevent backflow of the liquid from the tube into the bag or cartridge. The compression of the tube and the valves cooperate to ensure that the liquid is expressed from the flexible tube into the hands of the user. The flexible tube is typically positioned in the housing in a location convenient to the location of the housing portion that triggers dispensing of the liquid.

The shell or case also comprises a containment means or holding means for the chemical. Such a holding means can comprise a reservoir or chamber that can contain a sufficient quantity of chemical to satisfy requirements for a period of use of the chemical. A period of use can comprise one day, two days, a week, two weeks or a month or more of use. The period of use depends on the type of chemical, its shelf life and rate of use. Such holding means can comprise a volume within the case of at least 50 ml, preferably 100 ml to 5 liters of volume. Most preferably, the volume of the holding means is about 150 to 1000 ml for reasons of convenience and ease of insertion.

In a preferred mode, the chemical is encased in a flexible bag or cartridge that can be inserted into the holding means of the case. A cartridge can have any arbitrary shape. Useful shapes include cylinders, cubes, rectangular solids, triangular solids, cones, truncated cones, bottle shapes, or any arbitrary shape designed to fit particularly in a holding means of a particular dispenser. Such bags or cartridge shapes can have unique shapes to ensure that a cartridge is designed to fit in a particular dispenser and intended to dispense a particular chemical. Such bags or cartridges can be made from cardboard, paperboard, etc.; metallic substances such as aluminum, metallized polyester; thermoplastic films such as polyethylene, polypropylene, polyethylene terephthalate, polyvinyl chloride, polystyrene, a thermoplastic composite material, etc. Such bags or cartridges can be sized as discussed above to contain a sufficient volume or weight of chemical to satisfy requirements for a given period.

The liquid chemical can be provided in the form of the contents of a flexible bag. The contents can be removed by applying pressure to the bag or by pumping liquid from a tube attached to the bag. The bag or cartridge of the invention is typically equipped with a closed chemical port. Typically, the port comprises a flexible tube from which the liquid can be dispensed. The bag or cartridge is designed to deliver the chemical through the port after the closed port is opened. The port can be opened by removal of a closing membrane, piercing a membrane, removing a screw cap, or separating any of a variety of conventional closing means from the cartridge portal. In a preferred mode, the portal is covered by a cap or a paper, film, metallized film, or other thin piercable web closure. When the cartridge is inserted into the holding means, the web closure contacts an opening means that can pierce the web closure. The opening means is shaped and configured to provide a sufficient aperture in the web closure to permit a sufficient volume of the chemical to be dispensed for appropriate operation. The opening means can be configured to remove the portion of the opening means away from the portal to ensure that the opening does not become plugged. Such a bag or cartridge can be loosely fitted into the holding means of the case or can be shaped to conform exactly to the exterior shape of the cartridge. The holding means can also include a lid or cover such that the cartridge is fully enclosed by the case and cover. Such a cover can be removable or can be hingedly attached or slidingly attached to the case.

Counting Apparatus and Switch Actuation

The dispenser of the invention involves means to dispense a liquid product such as a sanitizer material or a hand soap. Such means includes a movable surface or pressure plate which compresses a soap delivery tube, thereby expressing hand soap into the user's hand. The counting means of the invention is operably connected to the dispenser means operated by the user to dispense the liquid. In a first embodiment, positioned behind the delivery tube is a membrane pressure switch which is activated each time the delivery tube is compressed. The device includes a counting apparatus which is connected electrically to the pressure switch. Data about every contact between the user (i.e.) each pressure plate depression (i.e. every pressure switch closing) is counted or captured by the counting apparatus.

Users will repeatedly contact dispensers (e.g.) by depressing the pressure switch to increase the amount (volume) of the dispensed liquid until satisfied. While the device of the invention records all pressure switch activations, that data can be manipulated in several different ways to generate several different pieces of information. The data, however, always provides reliable user data that discriminates between employees and each employee use.

In an alternate embodiment, positioned behind the delivery tube is a membrane pressure switch which is activated each time the delivery tube is compressed. The device includes a counting apparatus which is connected electrically to the pressure switch. Data about every contact between the user (i.e.) each pressure plate depression (i.e. every pressure switch closing) is counted or captured by the counting apparatus. While the device of the invention records all pressure switch activations, that data can be manipulated in several different ways to generate several different pieces of information. In this particular embodiment, the device maintains a cumulative sum total of dispenser usage, average activations per use and number of uses. This data could comprise total number of pressure plate depressions or alternatively could comprise total volume of hand soap dispensed.

Numerical Display

The first embodiment of the invention includes a numerical display capable of showing any data set generated by the device. Each employee's total usage counts can be displayed individually or in a data set of all employees. In addition, the display could also provide total daily soap usage individual soap usage, etc. Preferably, an LCD display with four to six digits is used to conserve energy. In an alternative embodiment, the invention can comprise an internal display, accessible via a supervisor's key. In this situation, only total-usage figures could be displayed.

Data Entry Keypad

One embodiment of the invention includes a keypad suitable for entering data including employee ID codes and supervisory codes as well. Preferably, this keypad would have four buttons, bearing the numbers one through four. This limitation is due to the typical size of hand soap dispensers. Four buttons is the most which fit easily onto the front of a dispenser while retaining adequate button size. Since ID codes could theoretically be of any length, four numbers would provide a sufficient number of unique IDs.

This keypad would be used for an employee to enter his/her own ID code in order to obtain a dispensation of hand soap. The keypad would also be used by supervisors in order to obtain total usage figures, as well as usage counts broken down by individual employees.

Data Manipulation and Retrieval

As discussed previously, the counting apparatus of the presently claimed invention registers all switch closures, regardless of frequency. It is necessary, however, to be able to distinguish between multiple closures caused by a single employee requesting additional hand soap and multiple closures caused by multiple employees each making in short succession single requests for soap. In order to accomplish this, the invention includes a microprocessor.

This microprocessor would permit the generation of several different pieces of data. First, it would determine the purpose of multiple switch closures and would act accordingly. In general, multiple switch closures are assumed to be the work of a single employee if less than a predetermined amount of time has elapsed since the previous activation.

In one embodiment the invention involves data collection or manipulation systems that monitors the usage of preferably a liquid product dispenser or a hand soap dispenser to report total number of hand soap doses dispensed between supervisor reset operations of the data collection system. The hand soap dispenser determines the trends of usage including average number of uses, liquid doses dispensed per use, total volume of hand soap dispensed during a use, volume of hand soap dispensed between resets, volume of soap dispensed per unit time and other similar data. As discussed above, the dispenser uses a compression switch sensor to detect the user input such as pressure on a dispensing bar in the dispenser. The dispenser can be placed into a data acquisition mode by inputting on the key pad a code causing the microprocessor to return data to the supervisor in response to such an appropriate input. In such a mode, the supervisor would input a code into the four position key pay of the dispenser. The dispenser readout or display would display nothing. The supervisor at that point could hit the dispensing lever or any data input button with a single impact and the display would read total number of all inputs, pushes or doses recorded by the dispenser electronics. Such data would record a "hit" each time a user contacted the dispenser with a single push. At a supervisor second input to the dispenser, the average number of touches or pushes per user would display on the readout. A third press of the push button or input would cause the dispenser to display the number of users inputting to the machine. The last input would cause the microprocessor to return to its data accumulation mode. A data accumulation mode of the dispenser counts data inputs from the users. A data acquisition mode permits the supervisor or other management personnel to obtain the usage data accumulated or calculated by the dispenser in a printed, visual or electronic format.

The simple counting device of this embodiment consists of a compression switch which can be compressed as a user compresses the bar that dispenses the liquid material such as liquid hand soap from a dispensing tube in the dispenser. Microchip PIC16C923 microcontroller can be installed with a replaceable battery and a user interface module is installed in the dispenser. The interface module consists of a numeric display and a push button switch (see FIGS. 10–11). The compression switch can be located behind the delivery tube of the liquid material dispensed. The switch is connected to an input of the microcontroller which counts all inputs. An input consists of a compression of the delivery tube by a user causing the contacts of the switch to close notifying the microcontroller that a single dose of hand soap was dispensed in response to a single input or compression of the dispenser components by a user. The microprocessor recognizes multiple doses within a short period of time and counts each dose but recognizes that the multiple doses involves a single use and a single user of the dispenser. The user interface module data can be collected by a user interface module.

Whenever the user interface module is attached to the dispenser, the count data can be displayed on the numeric display of the dispenser or read to the user interface module and its memory or printed on a printer attached or included in the module.

While usage figures for individual employees may be displayed via the numerical display, it may become cumbersome for supervisors to be limited to this display manner. Consequently, it is anticipated that supervisory personnel would also have the option of retrieving usage data by downloading into a handheld device.

Optionally, a push button would be provided which permits the user to request a display of personalized use data.

If the push button of the user interface module is pressed while attached, the device would reset to 0 for accumulation of new data after accumulated data is transferred in useful formats. In the preferred embodiment, the device will contain the following components. The dispensing device contains a stationary switch mounted behind the delivery tube which can be compressed as the user obtains a dose of the liquid material. The placement of the switch would be such that the switch would go from a normally open position to a normally closed position whenever the delivery tube is compressed. The microprocessor controller monitor is reopened or closed status of the switch and in response to the switches manipulates data according to programmed instructions within the microprocessor that maintains a running total of switch closures, a running total of switch closures per use and based on these data calculates other important usage information. In order to calculate useful data the dispenser needs calibration to establish the volume of liquid dispensed per dose. The condition for determining if a single use had occurred will be any two or more switch closures within a ten second interval. The dispenser would have a push button with two functions; a first function acts as a request or prompt with the delivery of stored data to a supervisor, and secondly, acts as a reset to zero out old totals and to begin accumulating new data at the end of a week, month, quarter, six month period or annually. Reset occurs when the push button is pressed and held for two or more seconds or other known reset mode well known to those of ordinary skill in the art. The dispenser could contain a visual read out such as a LED, LCD or other display to display usage data. The display could alternate between a calculated average of switch closures per use, total number of switch closures, a quotient of closures divided by calculated average of switch closures or any other data generated by the microprocessor.

In another embodiment the invention involves data collection or manipulation systems that monitors the usage of preferably a liquid product dispenser or a hand soap dispenser to report total number of hand soap doses dispensed between supervisor reset operations of the data collection system. As discussed above, the dispenser uses a compression switch sensor to detect the user input such as pressure on a dispensing bar in the dispenser.

The simple counting device of the alternative embodiment consists of a compression switch which can be compressed as a user compresses the bar that dispenses the liquid material such as liquid hand soap from a dispensing tube in the dispenser. Microchip PIC16C923 microcontroller can be installed with a replaceable battery. The compression switch can located behind the delivery tube of the liquid material dispensed. The switch is connected to an input of the microcontroller which counts all inputs. An input consists of a compression of the delivery tube by a user causing the contacts of the switch to close notifying the microcontroller that a single dose of hand soap was dispensed in response to a single input or compression of the dispenser components by a user The microprocessor recognizes multiple doses within a short period of time and counts each dose but recognizes that the multiple doses involves a single use and a single user of the dispenser. The dispensing device contains a stationary switch mounted behind the delivery tube which can be compressed as the user obtains a dose of the liquid material. The placement of the switch would be such that the switch would go from a normally open position to a normally closed position whenever the delivery tube is compressed. The microprocessor controller monitors the reopened or closed status of the switch and in response to the switches manipulates data according to programmed instructions within the microprocessor that maintains a running total of switch closures.

DETAILED DESCRIPTION OF THE DRAWINGS

FIG. 1 is a perspective view of a dispenser 100. This figure generally shows a housing 110 along with several key components. These components include a four-button keypad 120 for inputting data. Also shown is a sight-glass window 130, permitting easy assessment of the quantity of soap remaining. Pushbar 140 serves to activate the electronics contained within the dispenser and, of course, permits the dispensing of soap. The last feature seen in FIG. 1 is the LCD display 150. This is generally a four- to six-digit LCD display.

Figure 2:
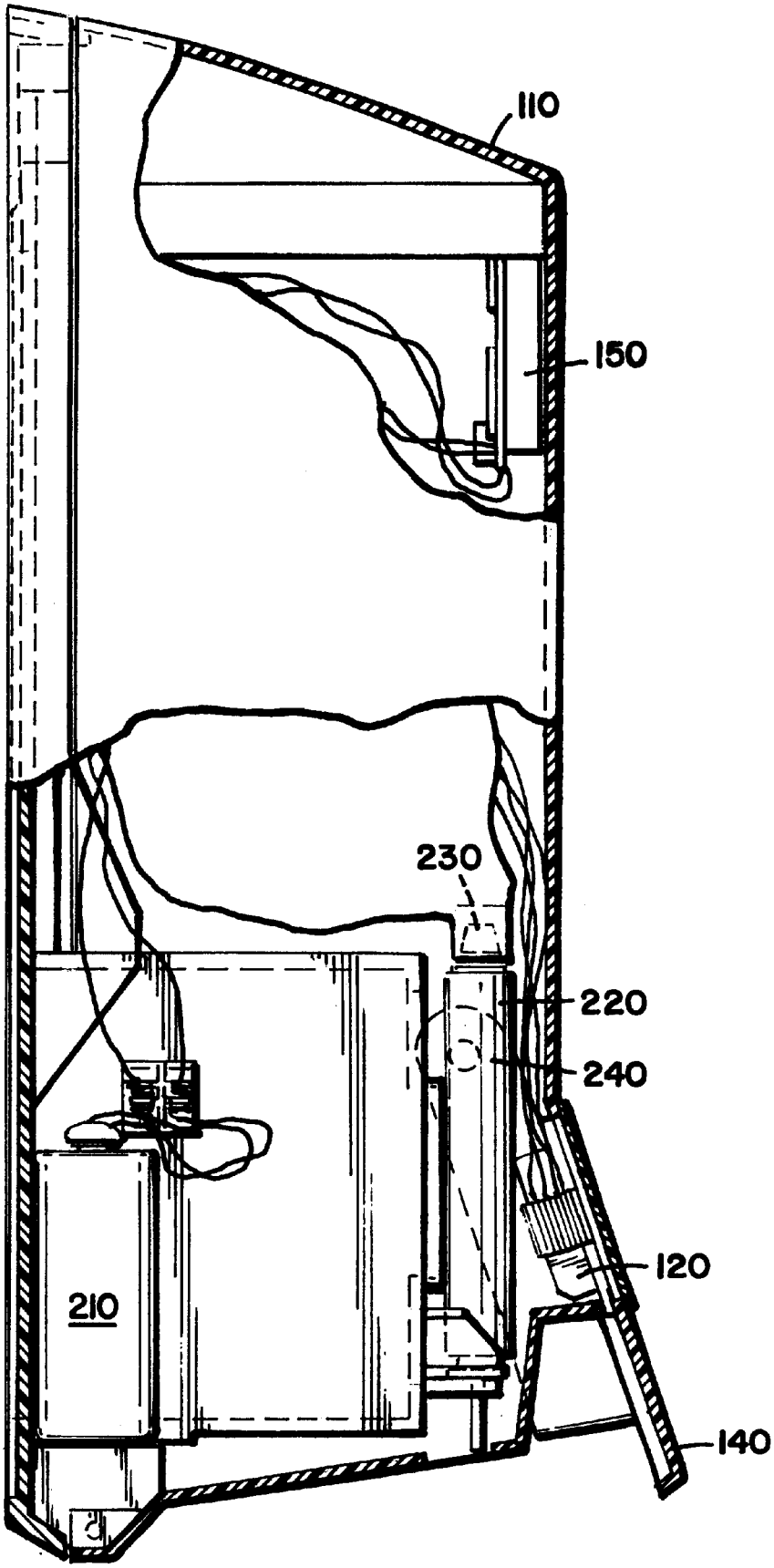
FIG. 2 is a cutaway side elevation of the dispenser of FIG. 1.

FIG. 2 is a cutaway side elevation of the dispenser shown in FIG. 1. This shows different views of some of the same features found in FIG. 1. Specifically, the housing 110 is seen, along with a side view of a keypad 120 and the LCD display 150. New features shown in FIG. 2 include a power supply 210, which in this instance is a 9-volt battery. Also seen here is the cooperative relationship among the dispensing tube 220, membrane switch 230 and the pushbar hinge mechanism 240, which is actually shown in phantom. When pushbar 140 is depressed, moving according to the hinged mechanism 240, two things happen simultaneously. The dispensing tube 220 is pinched, which provides for the dispensing of a predetermined amount of soap. Also, membrane switch 230 registers the dispensing.

Figure 3:
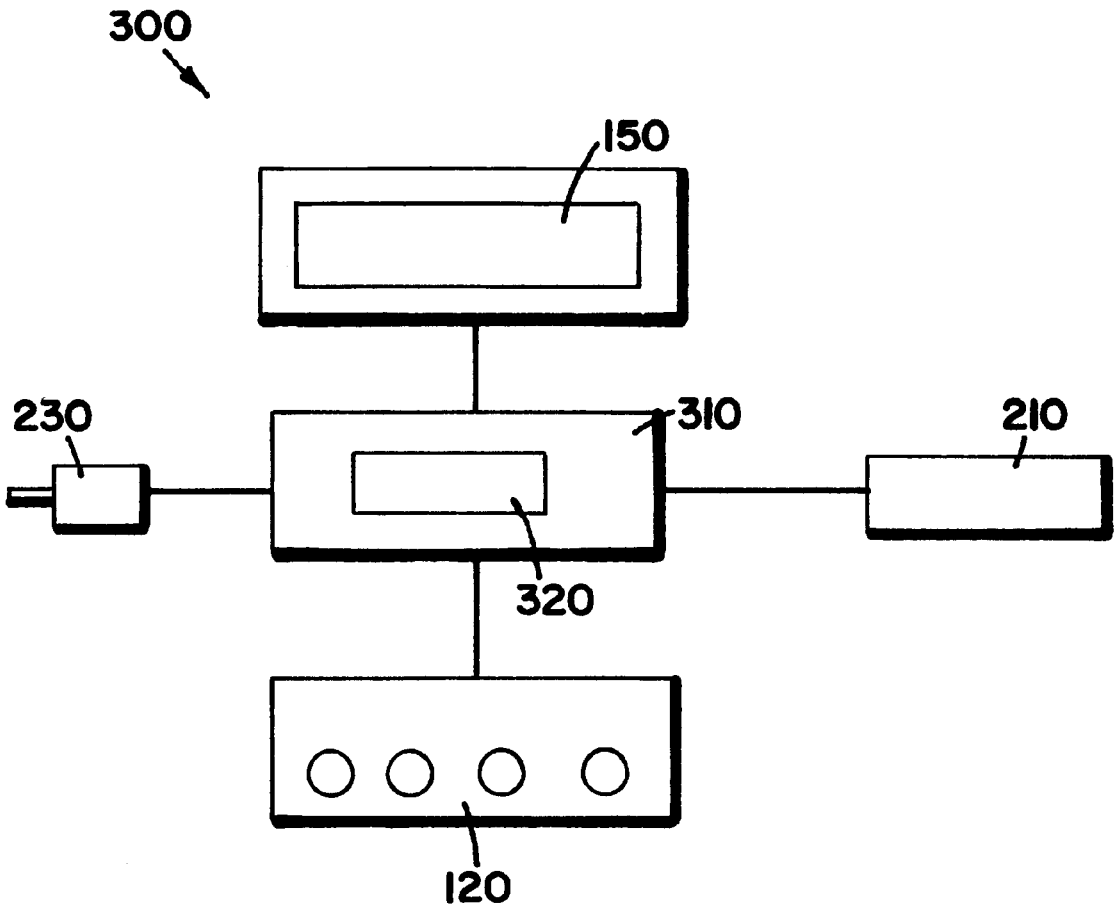
FIG. 3 is a block diagram of the dispenser of FIG. 1.

FIG. 3 is a block diagram 300 of the dispenser of FIG. 1. This shows the general components of the invention. Previously discussed is the keypad 120, LCD display 150, power supply 210 and pushbar switch or membrane switch 230. This figure shows how each of these general devices communicate with the processor 320 which is mounted on a circuit board 310.

FIGS. 4–8 combined show a detailed flow sheet 400. These flow charts represent the software necessary to control the processor of the first embodiment. Each figure will be described in detail.

Figure 4A:
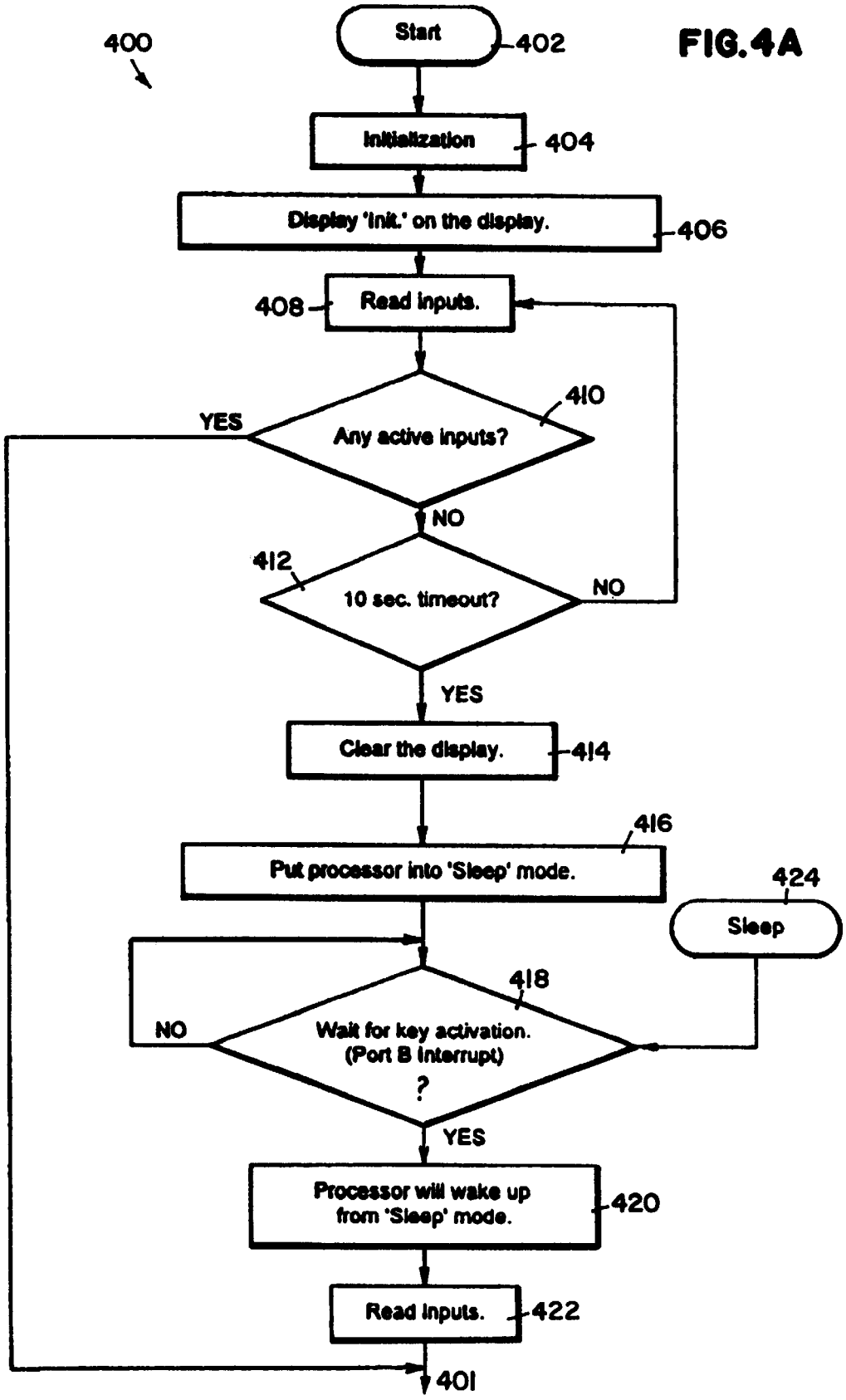
FIGS. 4–8 together are a flowsheet which shows the individual logic steps for the first embodiment.

FIG. 4A shows the beginning of the main flow chart. Flow starts in block 402 and then proceeds to block 404 which is an initialization step. During this step "Init" is displayed on the LCD display in block 406. Control then passes to block 408 which instructs the device to read the inputs. Block 410 is a decision block where the device decides if there are any active inputs. If yes, control passes to the bottom of FIG. 4A to point 401. If not, control passes to decision block 412 which determines if there has been a ten second timeout. If not, control passes back up to block 408 where inputs are read again. If yes, control passes to block 414 where the display is cleared. Control then passes to block 416 where the processor is put into sleep mode. While in sleep mode, the device waits for key activation or for a port B interrupt. This is seen in decision block 418. If there is a key activation, control passes to block 420 where the processor will wake up from sleep mode and then proceed to block 422 where inputs are read. At this point control is at point 401 which is continued on FIG. 4B.

Figure 4B:
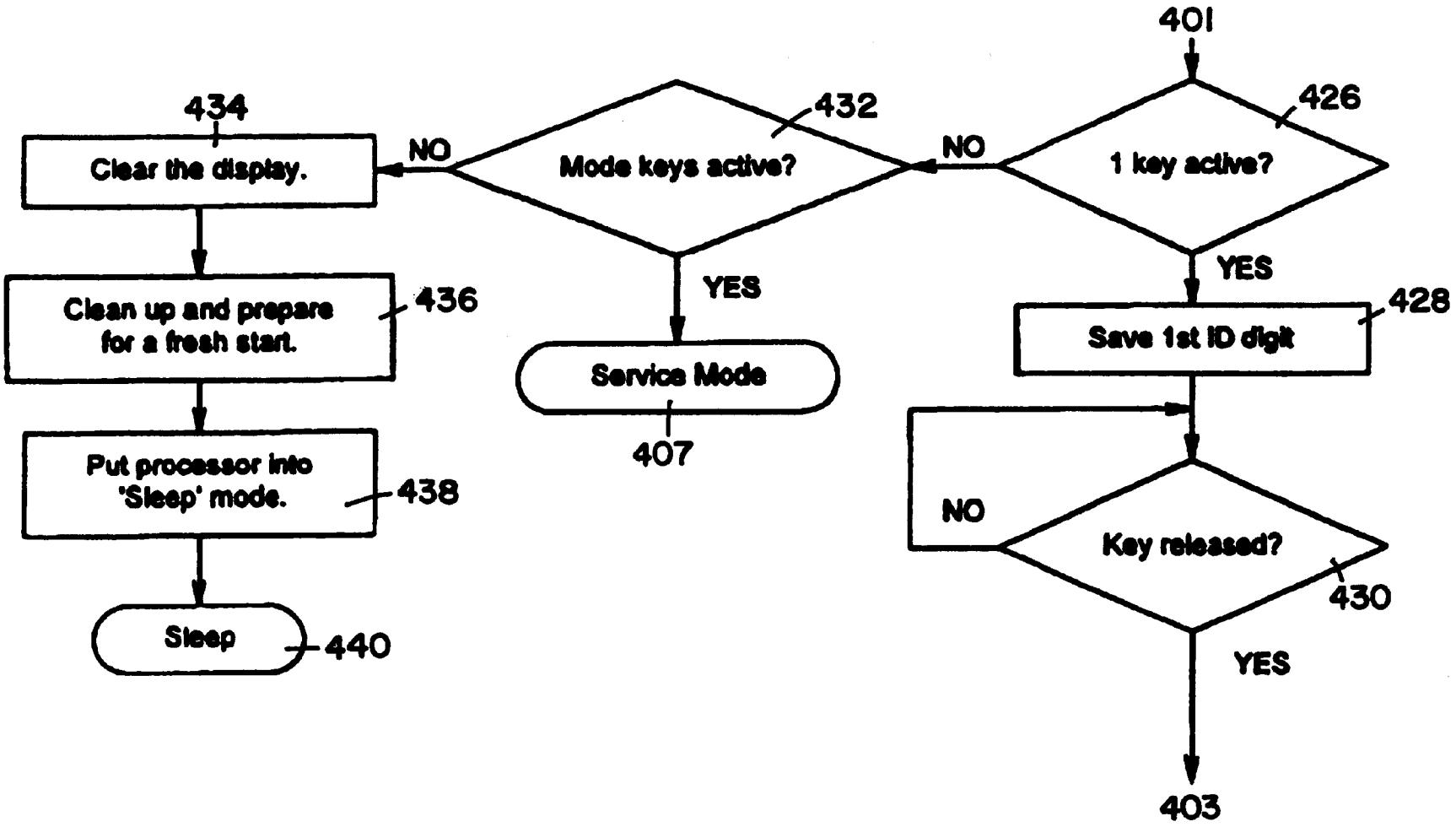

FIG. 4B begins at point 401 where control then passes to decision block 426 where the device determines if a single key is active. If not, control passes to decision block 432 where the device determines if the mode keys are active. If yes, control passes to block 407 which describes the service mode which is described in detail in FIG. 5. If not, control passes to block 434 where the display is cleared. Flow continues to block 436 where the device cleans up and prepares for a fresh start. In block 438 the processor is put into sleep mode as indicated by block 440. Now returning to decision block 426, if a single key is active, control passes to block 428 where the device saves the first ID digit, then to block 430 where the device determines if the key has been released. If yes, control continues to point 403, which is continued on FIG. 4C.

FIG. 4C begins at control point 403 and is continued from the previous figure. Control passes to decision block 442 where the device determines if there has been a ten second timeout. If yes, control passes to block 460 where the display is cleared and then passes to block 462 where the device prepares for a fresh start and finally passes to block 464 where the processor is put into sleep mode as denoted by block 466. If there has not been a ten second timeout in decision block 442, control passes to decision block 444 where the device determines if a second ID digit has been entered. If yes, the device saves the second ID digit in block 446. Block 448 is a decision block where the device determines if the key has been released. If yes, control passes to block 450 wherein the ID and current count are displayed on the LED display. At this point control passes to decision block 452 to determine if a ten second timeout has occurred. If yes, control passes through block 468 through 470, 472 and finally 474 where the processor sleeps. Returning to block 452, if there has not been a ten second timeout, control passes to block 454 wherein the device asks if the lever switch has been activated. If yes, control passes to block 456 where the device increases by one the count for the chosen ID and control then passes to block 458 where the ID and incremented count are displayed for ten seconds. Control is now at point 405 which is continued on FIG. 4D.

Figure 4D:
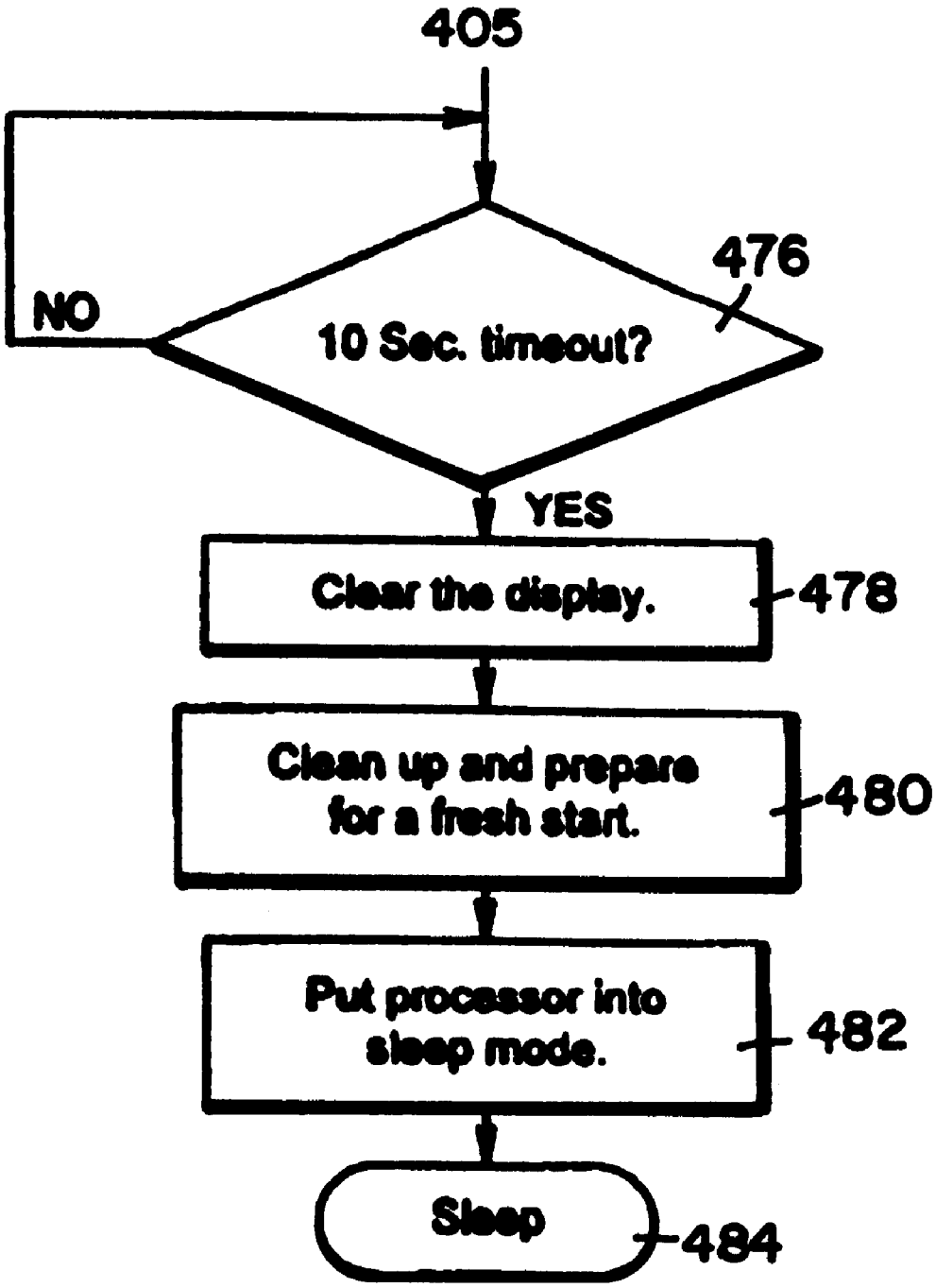

FIG. 4D is the fourth and final portion of the main flow sheet. From point 405 control passes to decision block 476 where the device determines if there is a ten second timeout. If yes, control passes to block 478 where the display is cleared. The device then cleans up and prepares for a fresh start in block 480. The processor is put into a sleep mode at 482 and sleeps as shown at block 484.

Figure 5:
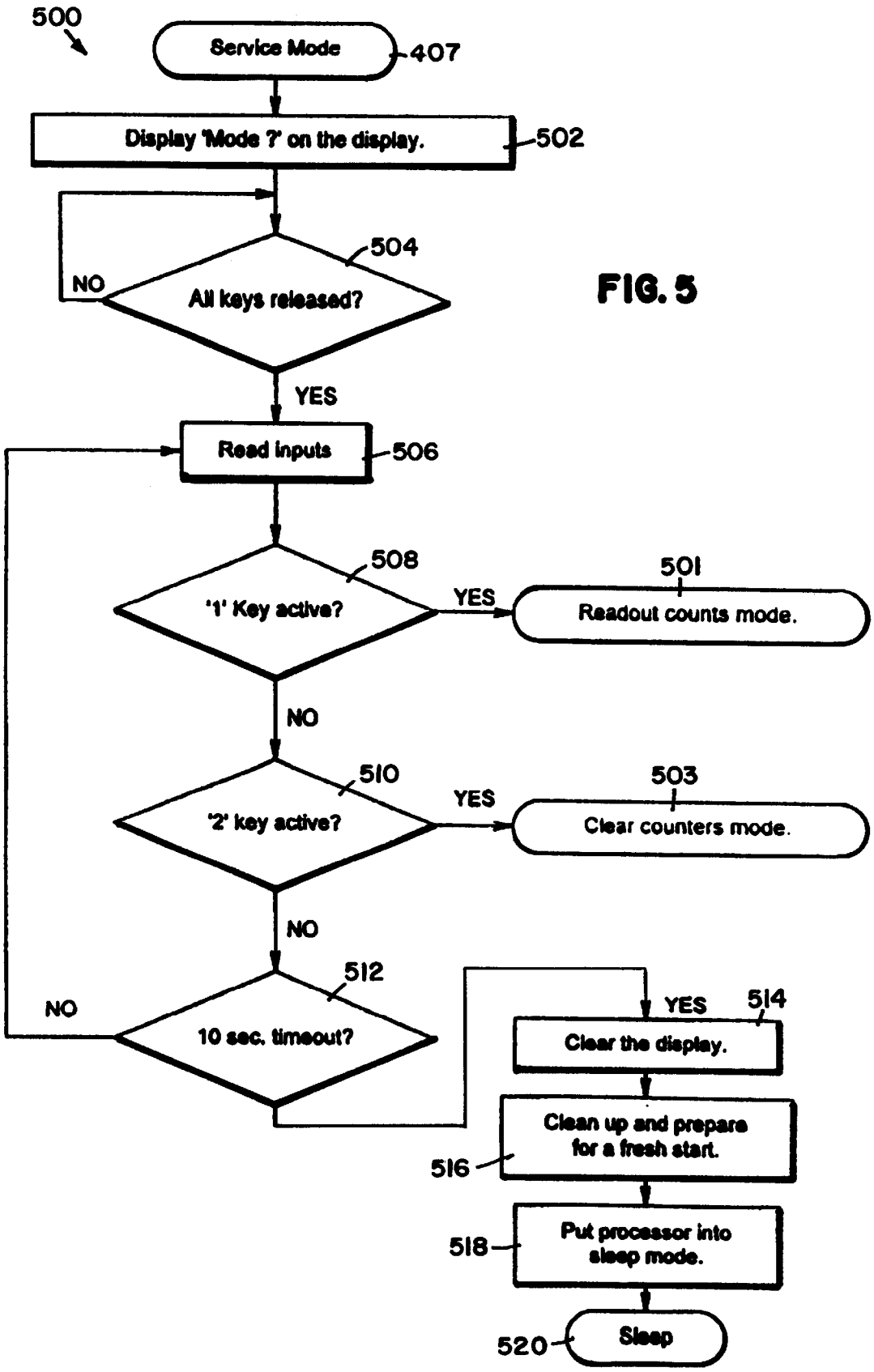

FIG. 5 shows the service mode of the invention. The flow begins at block 407 and passes to block 502 wherein the device displays "Mode?" Flow then passes to decision block 504 where the device asks if all keys have been released. If yes, control continues flows to 506 where the device reads inputs. At decision block 508 the device asks if the one key is active. If yes, control passes to the read-out counts mode 501. If not, the device asks in decision block 510 if the two key is active. If yes, control passes to the clear counters mode 503. If not, control passes to decision block 512 where the device asks if there is a ten second timeout. If not, control passes back to block 506 where the inputs are read. If there is a ten second timeout, control passes to block 514 where the display is cleared, then to block 516 where the device cleans up and prepares for a fresh start. Flow then proceeds to block 518 where the processor is put into the sleep mode as indicated by block 520.

Figure 6A:
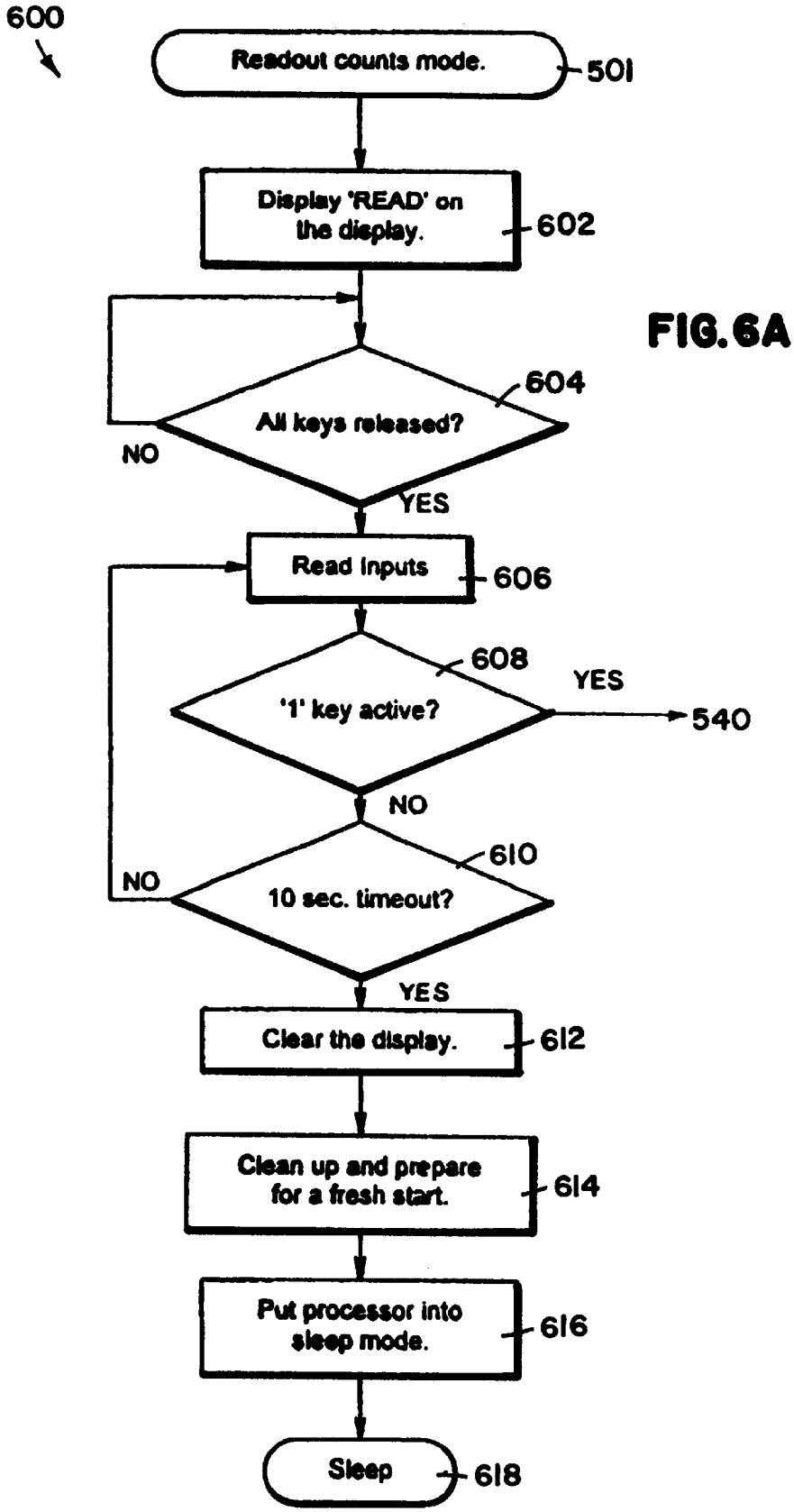

FIG. 6A is the beginning of the readout counts mode as mentioned in previous figure. From block 501 control passes to block 602 where "Read" is displayed on the LED display. From here control passes to decision block 604 where the device asks if all keys have been released. If yes, flow continues to block 606 where the inputs are read. Block 608 is a decision block where the device asks if the one key is active. If yes, control passes to point 540 which is continued on FIG. 6B. If not, control passes to decision block 610 where the device asks if there is a ten second timeout. If not, it returns to block 606 where the inputs are read. If yes, the display is cleared in block 612. In block 614 the device prepares for a fresh start. Flow continues to block 616 where the processor is put into sleep mode as indicated by block 618.

Figure 6B:
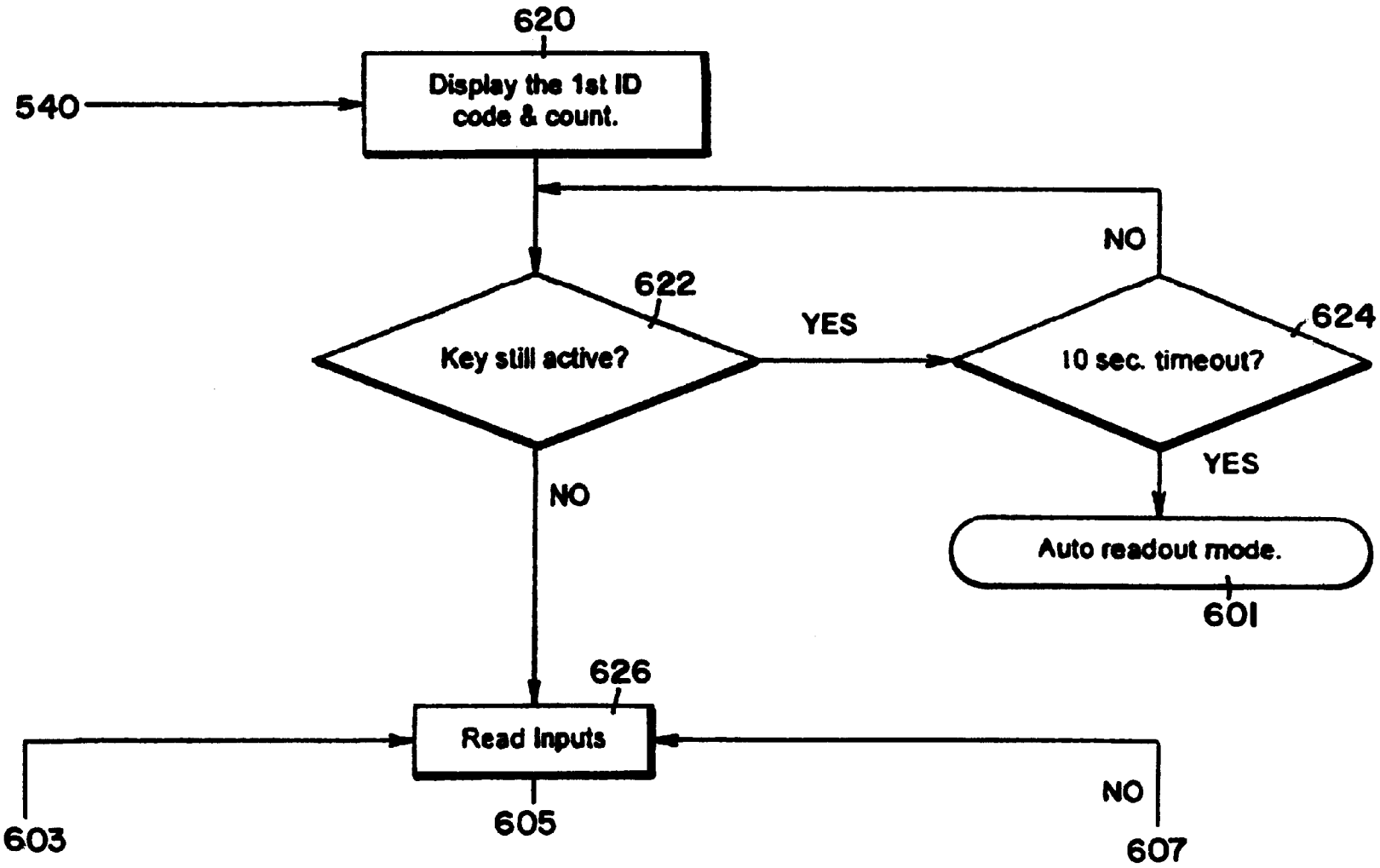

FIG. 6B is a continuation of the previous figure. From point 540 flow passes to block 620 where the device displays a first ID code and count. Flow then continues to decision block 622 where the device asks if the key is still active. If yes, control passes to decision block 624 where the device asks if there is a ten second timeout. If yes, control is passed to the auto readout mode indicated by block 601 and which is described in FIG. 7. If, however, at block 622 the key is not still active, control passes to block 626 where inputs are read. At this point control is at point 605, which is continued on FIG. 6C. Points 603 and 607 are return points which are linked to FIG. 6C.

Figure 6C:
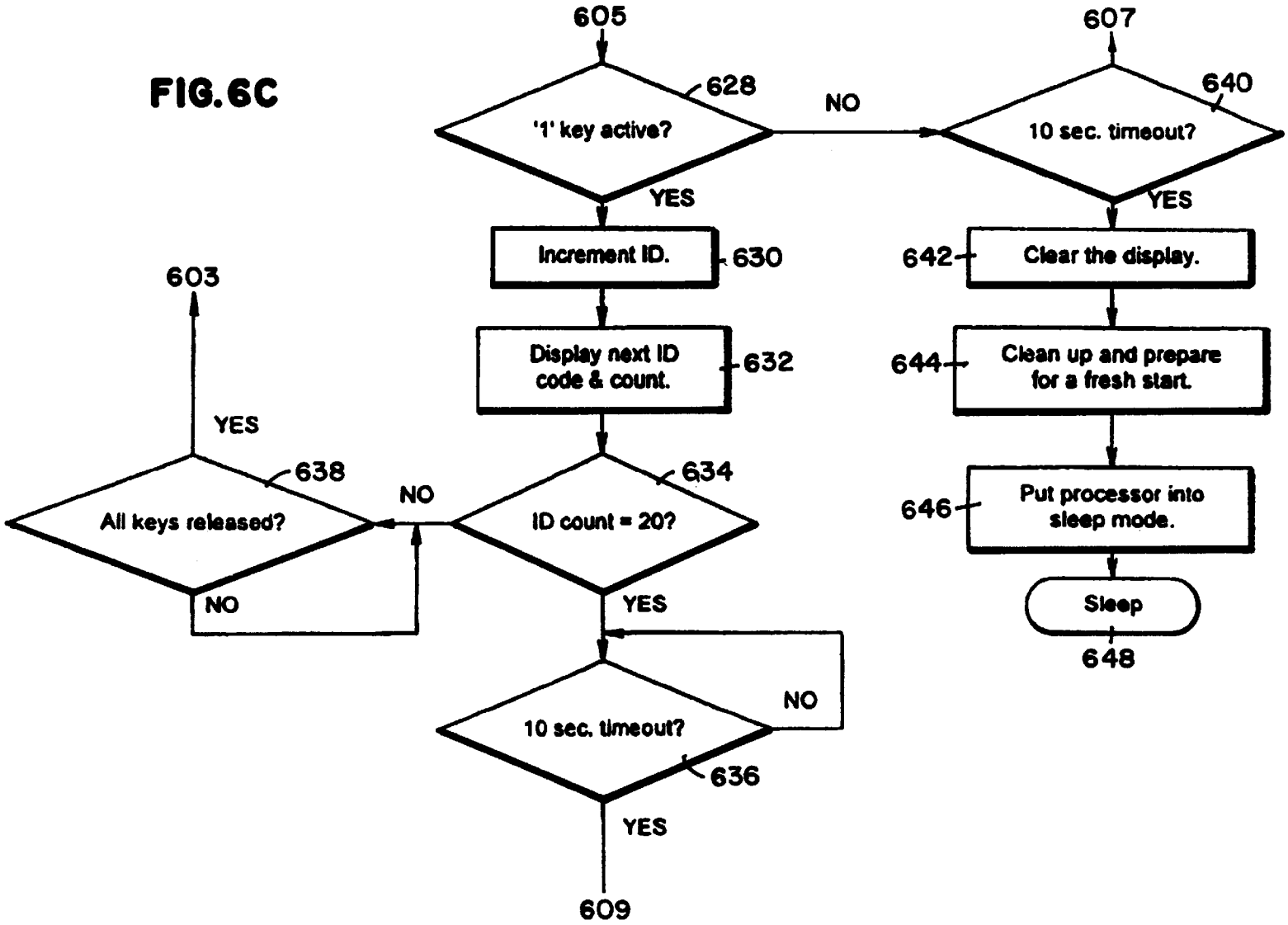

FIG. 6C begins at point 605 where flow continues to decision block 628 where the device asks if the one key is active. If not, control passes to decision block 640 where the device asks if there is a ten second timeout. If not, control passes back to point 607 as referenced on FIG. 6B. If, however, there is a ten second timeout, control passes to block 642 where the device clears the display. Flow then passes to block 644 where the device cleans up and prepares for a fresh start. In block 646 the processor is put into sleep mode as indicated by block 648. Returning to decision block 628, if the one key is active, control passes to block 630 where the device increments the ID. Flow then continues to block 632 where the device displays the next ID code and count. Control then passes to decision block 634 where the device asks if the ID count equals 20. If not, the device then asks in decision block 638 if all keys have been released. If yes, control passes to point 603 which is referenced in FIG. 6B. If however the ID count in block 634 is equal to 20, control passes to block 636 where the device asks if there is a ten second timeout. If yes, control passes to point 609 which is referenced in FIG. 6D.

Figure 6D:
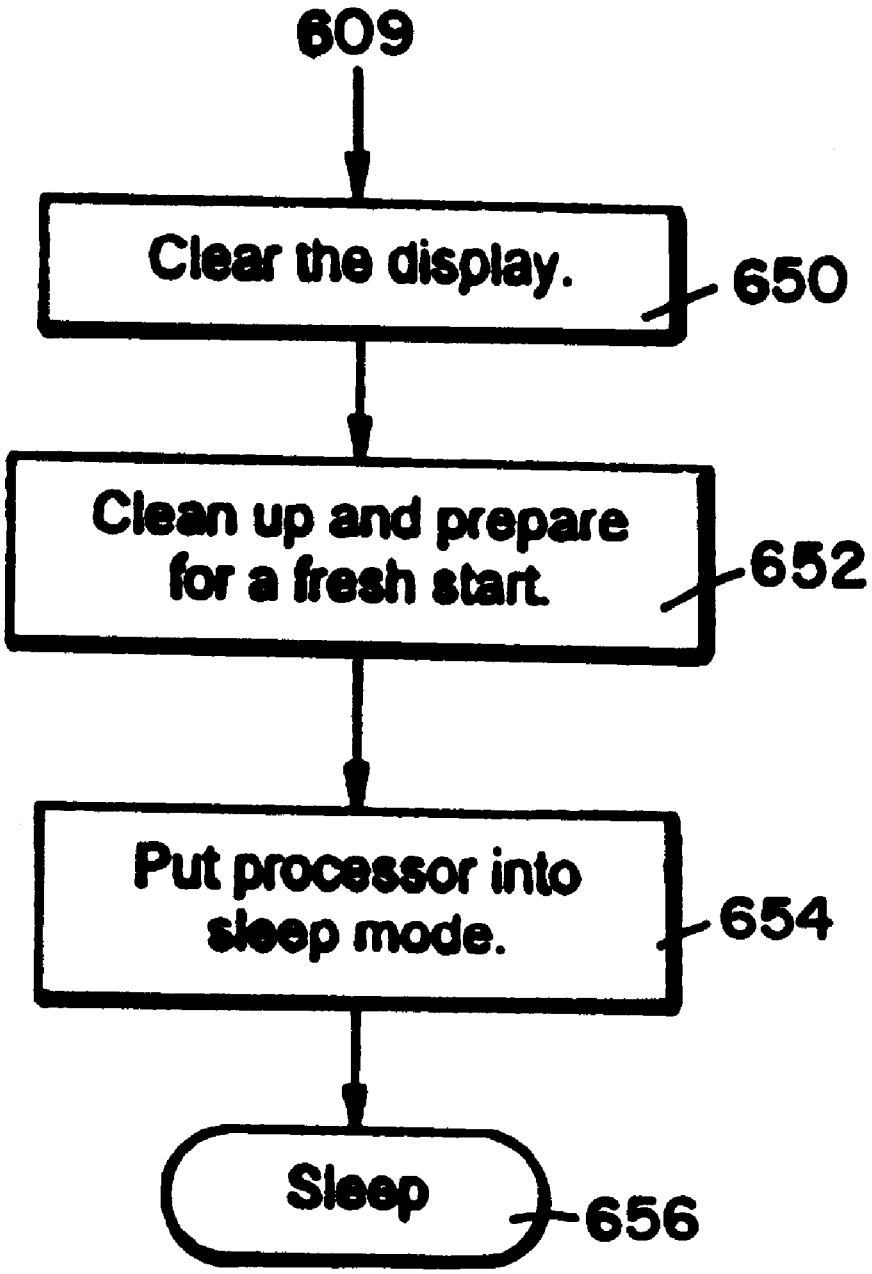

FIG. 6D begins at point 609 as referenced in FIG. 6C. Flow then passes to block 650 where the device clears the display. In block 652 the device cleans up and prepares for a fresh start and is put into sleep mode in 654 as indicated by block 656.

Figure 7:
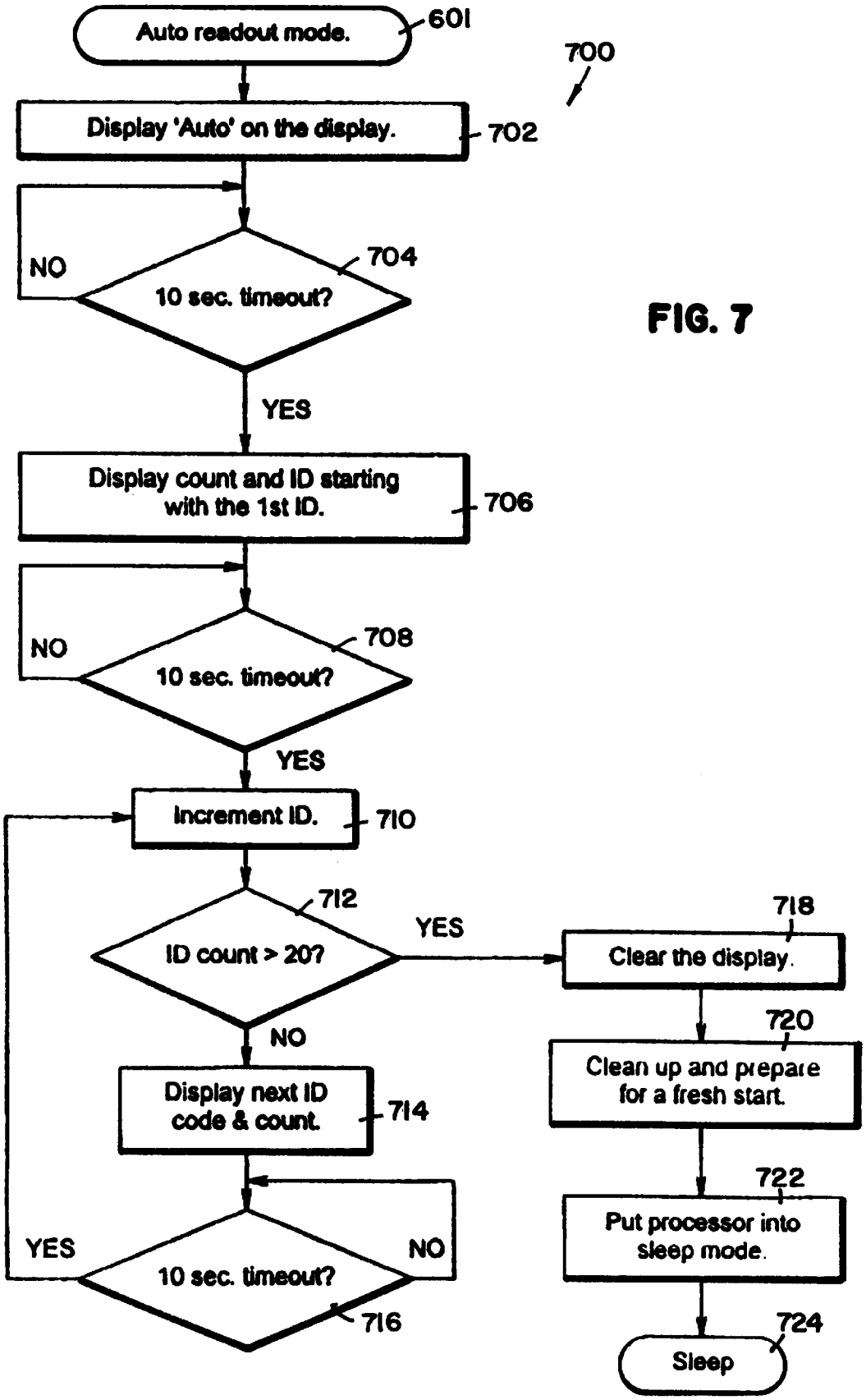

FIG. 7 shows the auto readout mode and begins at point 601. Control passes then to block 702 where the device displays the word "Auto" on the LED readout. Control then passes to block 704 where the device asks if there was a ten second timeout. If yes, control passes to block 706 where the count and ID are displayed starting with the first ID From here, control passes to block 708 where again the device asks if there is a ten second timeout. If yes, the device increments the ID in block 710. Control then passes to decision block 712 where the device asks if the ID count is greater than 20. If not, control passes to block 714 where the next ID code and count are displayed. Then at block 716 the device asks if there is a ten second timeout. If yes, control passes back to block 710 and the ID is incremented. Returning to decision block 712, if the ID count is greater than 20, control passes to block 718 where the display is cleared. In block 720, the device cleans up and prepares for a fresh start and then proceeds to block 722 where the processor is put into sleep mode as shown by block 724.

Figure 8:
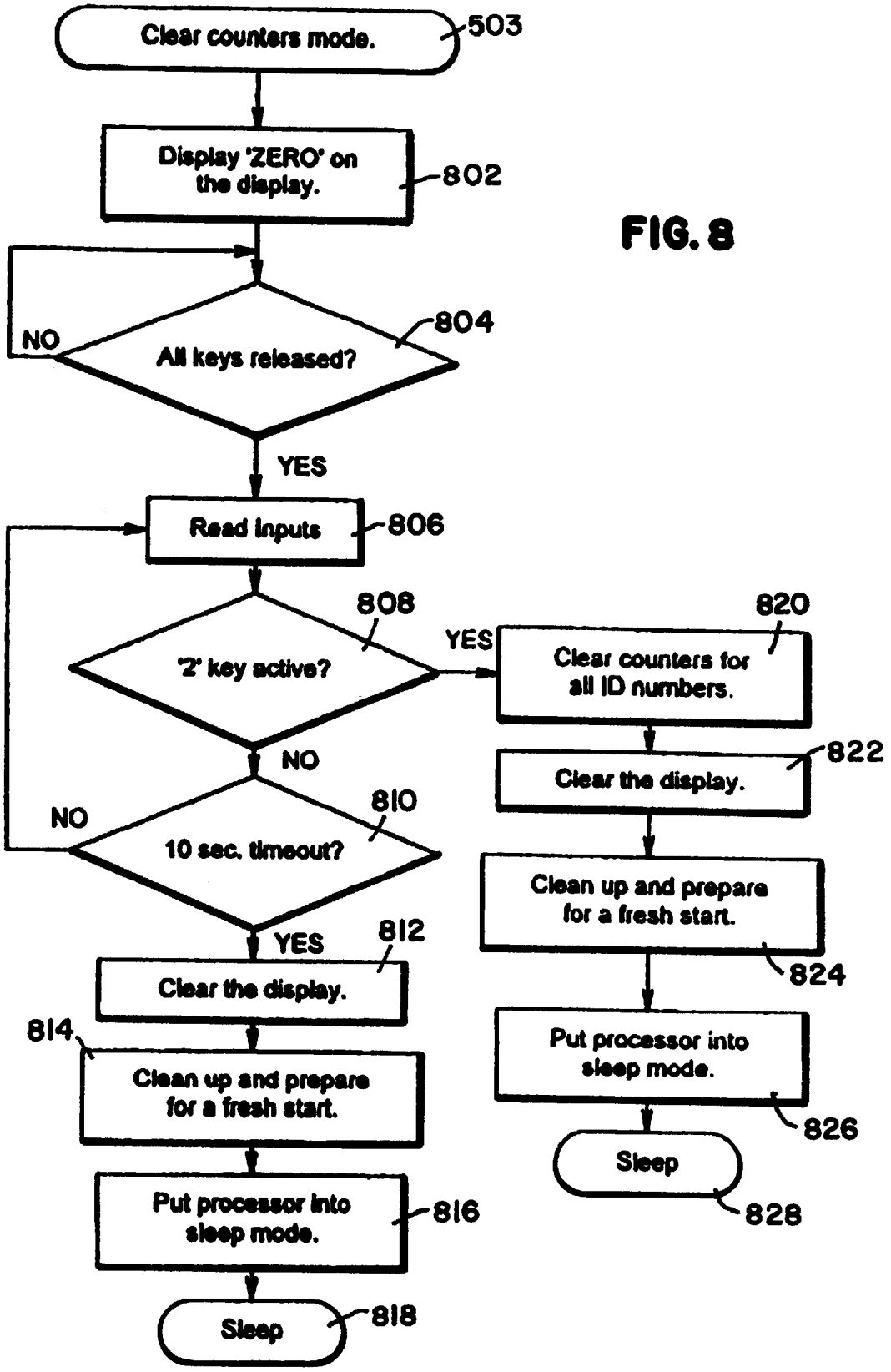

FIG. 8 shows the clear counters mode and begins at point 503. From point 503 control passes to block 802 where the device displays the word "zero" on the display. The flow then passes to decision block 804 where the device asks if all keys have been released. If yes, it continues to block 806 where the inputs are read. Control then passes to decision block 808 where the device asks if the two key is active. If yes, control passes to block 820 where the counters for all ID numbers are cleared. Then control passes to block 822 where the display is cleared, and in block 824 the device prepares for a fresh start and is put into a sleep mode in 826 as indicated by block 828. If, however, in block 808 the two key is not active, control passes to decision block 810 where the device asks if there is a ten second timeout. If not, control passes back to block 806 where the inputs are read. If there is a ten second timeout, however, control passes to block 812 where the display is cleared. The device prepares for a fresh start in block 814 and is put into sleep mode in block 816. This is seen in block 818.

Figure 9:
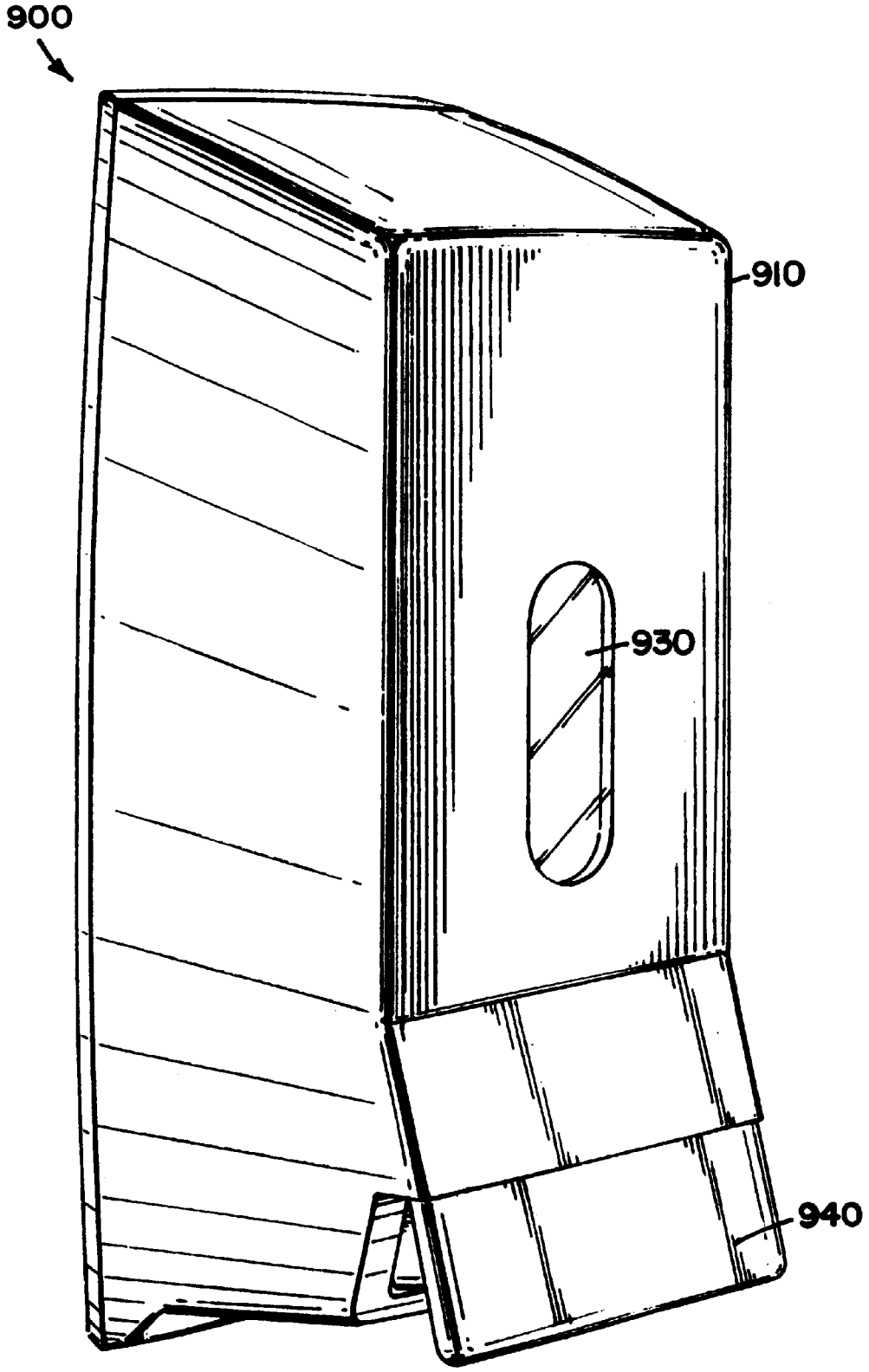
FIG. 9 is a perspective view of an alternative embodiment.

FIG. 9 is a perspective view of a dispenser 900. This alternative embodiment generally shows a housing 910 along with several key components. These components include a sight-glass window 930, permitting easy assessment of the quantity of soap remaining. Pushbar 940 serves to activate the electronics contained within the dispenser and, of course, permits the dispensing of soap.

Figure 10:
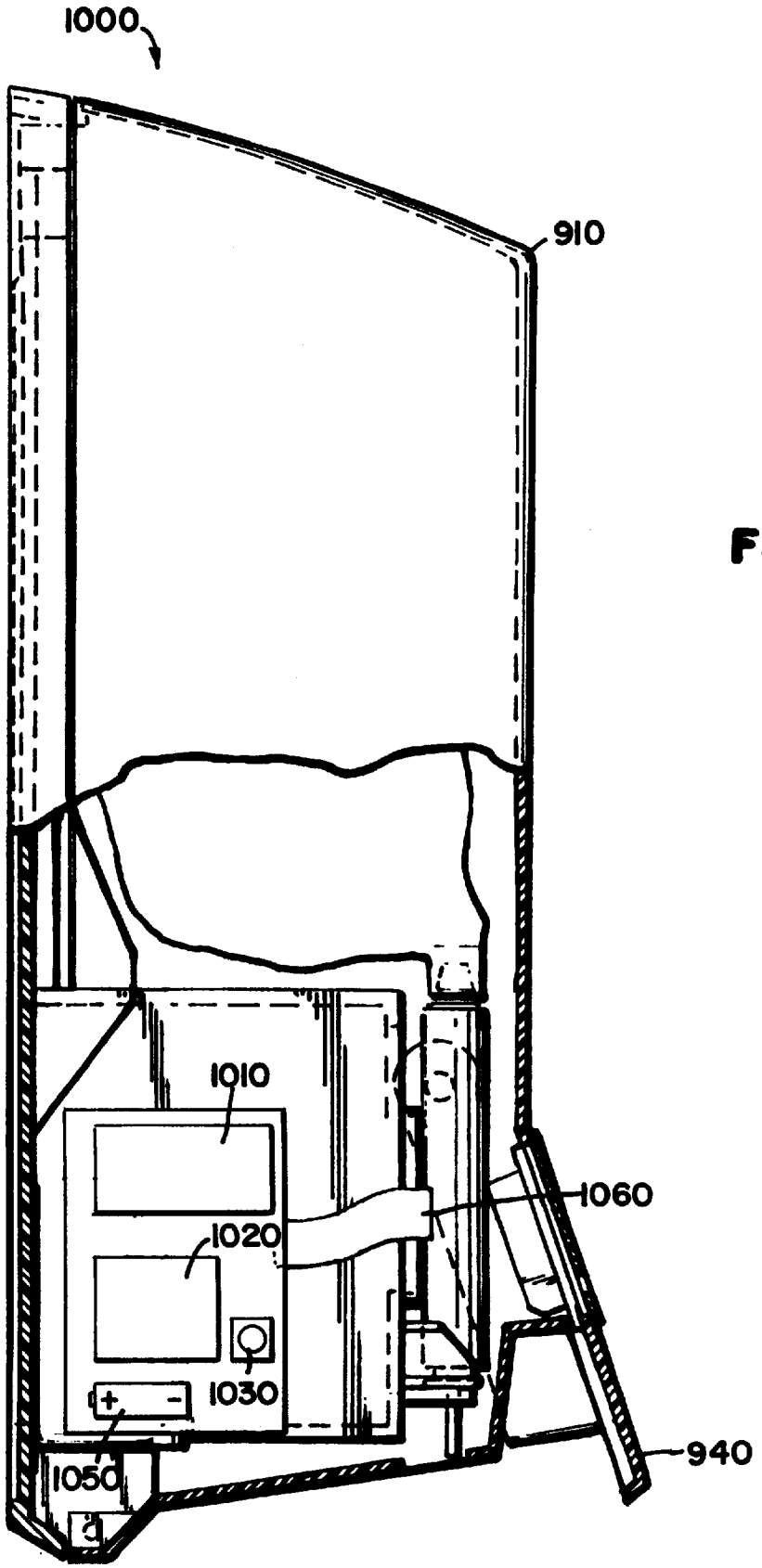
FIG. 10 is a cutaway side elevation of the dispenser of FIG. 9.

FIG. 10 is a cutaway side elevation of the dispenser shown in FIG. 9 and shows different views of some of the same features found in that Figure. Specifically, the housing 910 is seen, along with a side view of the push bar 940. New features shown in FIG. 10 include a power supply, which is a 6-volt battery 1050 and the membrane switch 1060. Also seen in this figure are the microprocessor 1020, a data request input 1030 and an internal display 1010. When pushbar 940 is depressed, two things happen simultaneously. The dispensing tube is pinched, which provides for the dispensing of a predetermined amount of soap. Also, membrane switch 1060 registers the dispensing.

Figure 11:
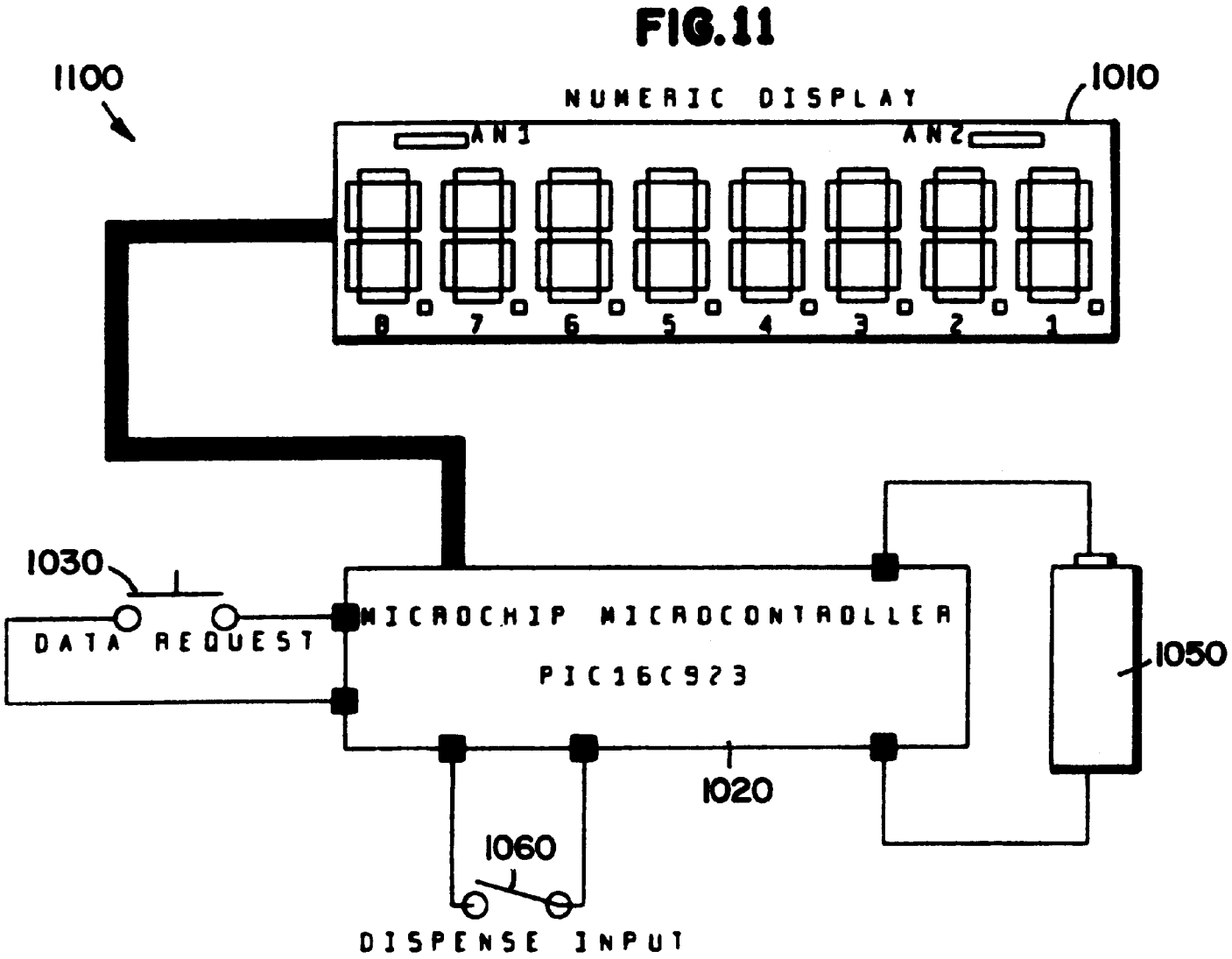
FIG. 11 is an electrical schematic for the alternative embodiment.

FIG. 11 is a block diagram 1100 of the alternative embodiment. It shows an LCD display 1010, a power supply

1050 and a particular microprocessor 1020. The dispenser input 1060 is the previously discussed membrane switch. Data request 1030 is typically a push button interface.

Figure 12:
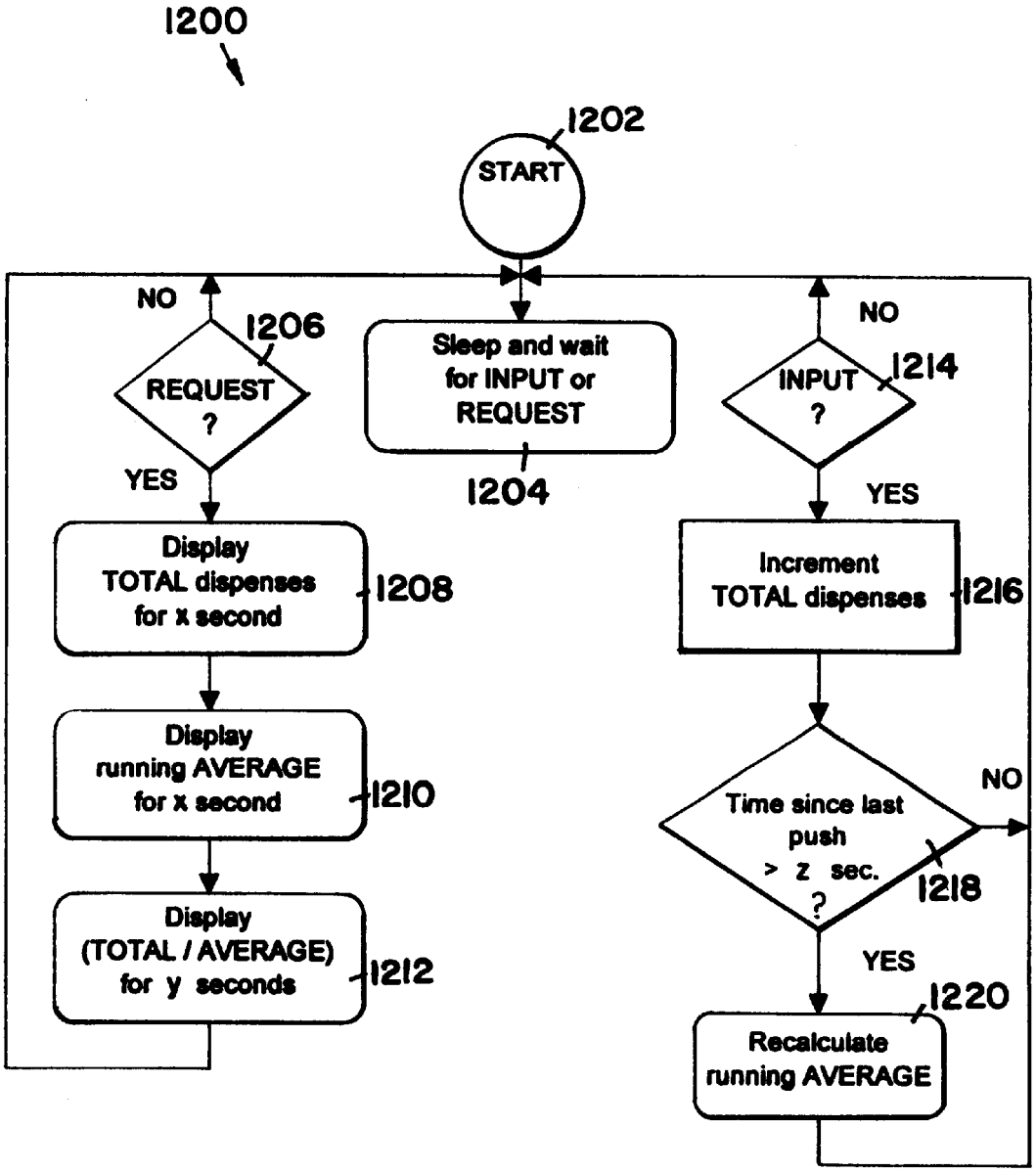
FIG. 12 shows the overall logic flow for the alternative embodiment.

FIG. 12 is a logical flow sheet 1200 which describes the overall logic flow of the alternative embodiment. The diagram starts at block 1202. Block 1204 shows the device idle while waiting for either input or request. Following the request side first, block 1206 is a decision block where the device determines if there has been a request. If yes, flow continues to block 1208 where the device displays total usage. Flow then continues to block 1210 where the device displays the running average. Finally flow continues to block 1212 where additional information is displayed. After this flow returns to block 1204 to wait for input or request.

Now following the input side of the diagram, block 1214 is a decision block where the device determines if any input has been entered. If yes, the total number of dispenses is incremented by one in block 1216. Flow then continues to decision block 1218 which concerns time elapsed since last input. If the time interval has been exceeded, flow continues to block 1220 where the device recalculates the running average. If not, control returns to block 1204 where the device sleeps and waits for input or request.

The above specification, and figures provide a complete description of the manufacture and use of the data competent dispenser of the invention. Since many embodiments of the invention can be made without departing from the spirit and scope of the invention, the invention resides in the claims hereinafter appended.

We claim:

1. A dispenser for a liquid product, the dispenser comprising means that collects and stores usage data for later retrieval, the dispenser comprising:

(a) a container of liquid product having means to dispense the liquid in response to a pressure input on an activating surface of the dispenser;

(b) electronic processing means that accepts a user identification and electronically counts each pressure input on the activating surface;

(c) electronic storage means configured to accumulate the user identification and each input for data processing; and (d) a housing that encloses the container, electronic processing means, and electronic storage means.

2. The dispenser of claim 1 wherein the data processing comprises usage figures calculated for individual users in response to individual identification numbers.

3. The dispenser of claim 1 wherein the data processing comprises total usage figures calculated in response to a pressure input requesting such data.

4. A dispenser for a liquid product, the dispenser comprising means that collects and stores usage data for later retrieval, the dispenser comprising:

(a) a container of liquid product having means to dispense the liquid in response to a pressure input on an activating surface of the dispenser;

(b) processing means that electronically counts each pressure input on the activating surface, said processing means configured to send usage data to a data output means;

(c) a data entry key pad configured to receive identification information and prompt the dispenser to send usage data to a data output means; and (d) a housing that encloses the container and processing means;

wherein any pressure input occurring under a single identification number and within a predetermined period is counted as a single use and wherein the processing means that counts each input also comprises data processing and accumulation means that calculates the individual usage of the dispenser based on key pad entry data.

5. The dispenser of claim 4 wherein said dispenser optionally comprises an external data port suitable for external data processing means such as a hand-held computer.

6. The dispenser of claim 4 wherein the data accumulation means calculates the number of pressure inputs per individual use.

7. The dispenser of claim 4 wherein the predetermined period is less than 10 seconds and the data output means comprises a remote display.

8. The dispenser of claim 4 wherein the data processing and accumulation means send data to the data output means in response to a code entered into the data entry key pad.

9. The dispenser of claim 4 wherein the data output means is a remote LCD display which numerically displays total hand soap usage.

10. The dispenser of claim 4 wherein the data output means is a remote LCD display which numerically displays hand soap usage per use.

11. The dispenser of claim 4 wherein the data output means is a remote LCD display which displays frequency of use.

12. An add-on system that can be installed on a dispenser for a liquid product, the system comprising means that collects and stores usage data for later retrieval, the system comprising:

(a) pressure input means, used with a container of liquid product having means to dispense the liquid in response to a pressure input on an activating surface of the dispenser, the input means generating a signal per each use of the pressure input;

(b) electronic processing means that electronically counts each pressure input on the activating surface, said processing means capable of sending usage data to a data output means;

(c) a data entry key pad that can identify each user and can prompt the processing means to send usage data to a data output means;

wherein any pressure input occurring under a single identification number and within a predetermined period is counted as a single use and wherein the processing means that counts each input also comprises data processing and accumulation means that can calculate the individual usage of the dispenser based on key pad entry data.

13. The dispenser of claim 12 wherein said dispenser optionally comprises an external data port suitable for external data processing means such as a hand-held computer.

14. The dispenser of claim 12 wherein the predetermined period is less than 10 seconds.

15. The dispenser of claim 12 wherein the dispenser further comprises a remote means to display frequency of use.

16. The system of claim 12 wherein the data output means is a remote LCD display which numerically displays total hand soap usage.

17. The system of claim 12 wherein the data output means is a remote LCD display which numerically displays hand soap usage per use.

18. The system of claim 12 wherein the data output means is a remote LCD display which displays frequency of use.

* * * * *